US009744594B2

(12) United States Patent
Maekawa et al.

(10) Patent No.: US 9,744,594 B2
(45) Date of Patent: Aug. 29, 2017

(54) METHOD FOR PRODUCING NICKEL MICROPARTICLES

(71) Applicant: M. TECHNIQUE CO., LTD., Izumi-shi, Osaka (JP)

(72) Inventors: Masaki Maekawa, Izumi (JP); Masakazu Enomura, Izumi (JP)

(73) Assignee: M. TECHNIQUE CO., LTD., Izumi-Shi (JP)

( * ) Notice: Subject to any disclaimer, the term of this patent is extended or adjusted under 35 U.S.C. 154(b) by 261 days.

(21) Appl. No.: 14/412,119

(22) PCT Filed: Oct. 2, 2012

(86) PCT No.: PCT/JP2012/075464
§ 371 (c)(1),
(2) Date: Dec. 30, 2014

(87) PCT Pub. No.: WO2014/041706
PCT Pub. Date: Mar. 20, 2014

(65) Prior Publication Data

US 2015/0174660 A1 Jun. 25, 2015

(30) Foreign Application Priority Data

Sep. 12, 2012 (JP) ..... 2012-201027

(51) Int. Cl.
*B22F 9/24* (2006.01)
*B22F 9/06* (2006.01)
(Continued)

(52) U.S. Cl.
CPC ..... *B22F 9/24* (2013.01); *B22F 1/0044* (2013.01); *B22F 9/06* (2013.01); *C22B 23/04* (2013.01)

(58) Field of Classification Search
None
See application file for complete search history.

(56) References Cited

U.S. PATENT DOCUMENTS 8,118,905 B2 2/2012 Enomura
8,623,415 B2 1/2014 Enomura
(Continued)

FOREIGN PATENT DOCUMENTS

CN 101784258 A 7/2010
CN 101795772 A 8/2010
(Continued)

OTHER PUBLICATIONS

Sun, "Production Method of Nano Material and Its Application," China Textile & Apparel Press, First Edition, Sep. 2012, pp. 86-90 (7 pages total), with a partial English translation.
(Continued)

*Primary Examiner* — George Wyszomierski
(74) *Attorney, Agent, or Firm* — Birch, Stewart, Kolasch & Birch, LLP

(57) ABSTRACT

The present invention addresses the problem of providing a method for producing nickel microparticles in which the ratio of crystallite's diameter to the particle diameter of the nickel microparticles is controlled. At least two types of fluids to be processed are used, including a nickel compound fluid in which a nickel compound is dissolved in a solvent, and a reducing agent fluid in which a reducing agent is dissolved in a solvent. Sulfate ions are included in the nickel compound fluid, and polyol is included in the nickel compound fluid and/or the reducing agent fluid. The fluid to be processed is mixed in a thin film fluid formed between at least two processing surfaces (1, 2), at least one of which rotates relative to the other, and which are disposed facing each other and capable of approaching and separating from each other, and nickel microparticles are precipitated. The present invention is characterized in that at this time, the ratio (d/D) of crystallite's diameter (d) to the particle diameter (D) of the nickel microparticle is controlled by control-
(Continued)

ling the pH of the nickel compound fluid introduced between the processing surfaces (1, 2) and the molar ratio of sulfate ions with respect to nickel in the nickel compound fluid.

16 Claims, 3 Drawing Sheets

(51) Int. Cl.
*C22B 3/00* (2006.01)
*B22F 1/00* (2006.01)

(56) References Cited

U.S. PATENT DOCUMENTS

| | | | | |
|---|---|---|---|---|
| 9,211,510 | B2 | 12/2015 | Enomura | |
| 9,387,536 | B2 * | 7/2016 | Enomura | B22F 9/24 |
| 9,492,763 | B2 * | 11/2016 | Aoyagi et al. | B01D 9/0063 |
| 2008/0034921 | A1 | 2/2008 | Vanheusden et al. | |
| 2009/0025510 | A1 | 1/2009 | Lee et al. | |
| 2010/0155310 | A1 | 6/2010 | Enomura | |
| 2010/0243947 | A1 | 9/2010 | Enomura | |
| 2010/0322997 | A1 | 12/2010 | Enomura | |
| 2010/0327236 | A1 | 12/2010 | Enomura | |
| 2013/0333520 | A1 | 12/2013 | Enomura | |

FOREIGN PATENT DOCUMENTS

| | | | |
|---|---|---|---|
| CN | 101868316 | A | 10/2010 |
| EP | 2177294 | A1 | 4/2010 |
| JP | 2007-197836 | A | 8/2007 |
| JP | 2011-195888 | A | 2/2009 |
| WO | WO 2009/008390 | A1 | 1/2009 |
| WO | 2009-24254 | A | 2/2009 |
| WO | WO 2012/014530 | A1 | 2/2012 |
| WO | WO 2012/124046 | A1 | 9/2012 |

OTHER PUBLICATIONS

Zheng et al., "Anion Effects on Polymorphs Formation in Hydrothermal Synthesis of Titanium Dioxide Nanocrystal," Artificial Crystallography Journal, vol. 29, No. 5, Jan. 1, 1970, p. 120 (2 pages total), with an English translation.

* cited by examiner

METHOD FOR PRODUCING NICKEL MICROPARTICLES

The present invention relates to a method for producing nickel microparticles.

Nickel microparticle is the widely used material as a conductive material in a laminated ceramic condenser and a substrate, or as an electrode material and so forth, wherein the said materials having the particle diameter and the particle size distribution thereof controlled in accordance with the purpose are used. Besides, physical properties of the nickel microparticle also change by the crystallite's diameter thereof; and thus, for example, even if the particle diameter of the nickel microparticle is the same, the burning temperature may be made lower for the smaller crystallite thereof, and also shrinkage after the heat treatment may be made smaller for the larger crystallite thereof. Therefore, the technology to control the crystallite's diameter of the nickel microparticle, especially the technology to control the ratio of the crystallite's diameter relative to the particle diameter in the nickel microparticle is necessary.

Generally, the crystallite means the maximum congregate that can be considered to be a single crystal; and the size of this crystallite is called as the crystallite diameter. To measure the crystallite diameter, there are a method that lattice fringe of the crystallite is confirmed by using an electron microscope and a method that the crystallite diameter is calculated from the diffraction pattern obtained by using an X-ray diffraction apparatus and the Scherrer equation.

$$\text{Crystallite diameter } D = K \times \lambda / (\beta \times \cos\theta) \qquad \text{Scherrer equation}$$

Here, for calculation, K, the Scherrer's constant, is K=0.9; $\lambda$ is the wavelength of the X-ray tube used; $\beta$ is the half-width; and $\theta$ is the diffraction angle.

The method for producing the nickel microparticle can be classified roughly into a gas phase method and a liquid phase method.

In Patent Document 1, the nickel powder having, relative to total number of the particles, 20% or less as the number of the particles which have the particle diameter of 1.5 times or more relative to the average particle diameter (D50 value) as obtained by the particle diameter distribution measurement by the laser diffraction scattering method, while having, relative to total number of the particles, 5% or less as the number of the particles which have the particle diameter of 0.5 times or less relative to the average particle diameter (D50 value), and also having 400 Å or more as the average crystallite's diameter in the nickel particles, is described. Also, it is described therein that this nickel powder is obtained by the way in which after the nickel powder produced by the wet method or the dry method is mixed with fine powder of an alkaline earth metal compound or by the way in which surface of each of the nickel powders is coated with the alkaline earth metal compound, these are heat-treated at the temperature lower than the melting temperature of the alkaline earth metal compound in the atmosphere of an inert gas or a slightly reductive gas; and it is further described that the powder having the average particle diameter in the range of 0.05 to 1 μm as measured by the SEM observation is preferable.

In Patent Document 2, the nickel fine powder is described which is obtained by vaporizing the nickel by the thermal plasma followed by condensing and then making it fine powder; this powder having the number-average particle diameter in the range of 0.05 to 0.2 μm as measured by the scanning electron microscopic observation, the sulfur content therein being in the range of 0.1 to 0.5% by mass, and the ratio of the coarse particle with the size of 0.6 μm or more contained in the nickel fine powder being 50 ppm or less based on the number thereof. Besides, it is described that this nickel fine powder has its crystallite's diameter of preferably 66% or more relative to the foregoing number-average particle diameter as measured by the X-ray diffraction analysis.

In Patent Document 3, the nickel nanoparticle which is obtained by the way in which a reducing agent, a dispersant, and a nickel salt are added to a polyol solvent to obtain a mixed solution, and then, after this mixed solution is stirred and heated, a reduction reaction is carried out by controlling the reaction temperature and time is described. Besides, it is described that the nickel microparticle having the uniform particle diameter as well as excellent dispersibility can be obtained.

In Patent Document 4, a method for producing a metal microparticle is described wherein a metal compound is reduced in a thin film fluid formed between processing surfaces which are disposed in a position they are faced with each other so as to be able to approach to and separate from each other, at least one of which rotates relative to the other. According to the producing method of Patent Document 4, it is described that a metal colloid solution with monodispersion having smaller average particle diameter than metal microparticle obtained by a usual reaction method can be obtained.

PRIOR ART DOCUMENTS

Patent Document

Patent Document 1: Japanese patent Laid-Open Publication No. 2007-197836

Patent Document 2: Japanese patent Laid-Open Publication No. 2011-195888

Patent Document 3: Japanese patent Laid-Open Publication No. 2009-24254

Patent Document 4: International Patent Laid-Open Publication No. WO 2009/008390

Problems to be Solved by the Invention

Generally speaking, the particle size distribution of the nickel microparticle obtained by the gas phase method is widely spread, so that not only to make the particle diameter and the crystallite's diameter of the nickel microparticle uniform is difficult but also the energy cost in the production thereof becomes higher. In addition, in order to obtain the nickel microparticle having the narrow particle diameter distribution and the large crystallite's diameter as described in Patent Document 1 and also to obtain the nickel microparticle having a lower ratio of the coarse particle relative to the total and also having a larger ratio of the crystallite's diameter relative to the average particle diameter as described in Patent Document 2, the producing process thereof becomes complicated so that the energy consumption during the producing thereof becomes larger. Besides, there is a problem of contamination with foreign matters.

In the liquid phase method, as compared with the gas phase method, the particle diameter of the nickel microparticle can be controlled easier and the production cost thereof may be made low more easily; however, control of the crystallite's diameter is more difficult. In Patent Documents 3 and 4, the particle diameter of the metal microparticle including the nickel microparticle is described; however, there is no description as to the crystallite's diameter thereof. Therefore, there has been no disclosure yet with regard to the method for producing the nickel microparticle whose ratio of the crystallite's diameter relative to the particle diameter of the nickel microparticle is controlled by the liquid phase method.

In view of the situation as mentioned above, the present invention has an object to provide a method for producing nickel microparticle whose ratio of the crystallite's diameter relative to the particle diameter of the nickel microparticle is controlled.

Means for Solving the Problems

In order to solve the problems as mentioned above, the present invention provides a method for producing nickel microparticle, wherein the method uses at least two fluids to be processed, of these, at least one fluid to be processed is a nickel compound fluid in which a nickel compound is dissolved in a solvent, the nickel compound fluid contains a sulfate ion, at least one fluid to be processed other than the foregoing fluid to be processed is a reducing agent fluid in which a reducing agent is dissolved in a solvent, at least anyone fluid to be processed of the nickel compound fluid and the reducing agent fluid contains a polyol, these fluids to be processed are mixed in a thin film fluid formed between at least two processing surfaces which are disposed in a position they are faced with each other so as to be able to approach to and separate from each other, at least one of which rotates relative to the other, whereby the nickel microparticle is separated, and pH of the nickel compound fluid which is introduced into between the at least two processing surfaces and also a molar ratio of the sulfate ion relative to the nickel contained in the nickel compound fluid are controlled, whereby controlling a ratio of d/D, a ratio of crystallite's diameter (d) of the nickel microparticle relative to a particle diameter (D) of the nickel microparticle.

In addition, the present invention may be executed as an embodiment wherein while pH at room temperature of the nickel compound fluid which is introduced into between the at least two processing surfaces is kept to be constant in an acidic condition, the molar ratio of the sulfate ion relative to the nickel contained in the nickel compound fluid is controlled so as to be higher thereby making the ratio d/D higher, and while pH at room temperature of the nickel compound fluid which is introduced into between the at least two processing surfaces is kept to be constant in an acidic condition, the molar ratio of the sulfate ion relative to the nickel contained in the nickel compound fluid is controlled so as to be lower thereby making the ratio d/D lower.

In addition, the present invention may be executed as an embodiment wherein the nickel microparticle having the ratio d/D of 0.30 or more is obtained by using the below-mentioned fluid as the nickel compound fluid. Thus, the nickel compound fluid, wherein pH of the nickel compound fluid at room temperature is 4.1 or lower, and the molar ratio of the sulfate ion relative to the nickel contained in the nickel compound fluid is 1.0 or more, is used.

In addition, the present invention may be executed as an embodiment, wherein the nickel microparticle having the crystallite's diameter (d) of 30 nm or more is obtained by using the below-mentioned fluid as the nickel compound fluid. Thus, the nickel compound fluid, wherein pH of the nickel compound fluid at room temperature is 4.1 or lower, and the molar ratio of the sulfate ion relative to the nickel contained in the nickel compound fluid is 1.0 or more, is used.

In addition, the present invention may be executed as an embodiment, wherein the nickel microparticle having the crystallite's diameter (d) of 30 nm or more is obtained by using the below-mentioned fluid as the nickel compound fluid. Thus, the nickel compound fluid, wherein pH of the nickel compound fluid at room temperature is in the range of 4.1 or more and 4.4 or lower, and the molar ratio of the sulfate ion relative to the nickel contained in the nickel compound fluid is more than 1.1, is used.

In addition, the present invention may be executed as an embodiment, wherein the nickel microparticle having the ratio d/D of 0.30 or more is obtained by using the below-mentioned fluid as the nickel compound fluid. Thus, the nickel compound fluid, wherein pH of the nickel compound fluid at room temperature is in the range of 4.1 or more and 4.4 or lower, and the molar ratio of the sulfate ion relative to the nickel contained in the nickel compound fluid is 1.2 or more, is used.

In addition, the present invention may be executed as an embodiment, wherein the polyol is at least the one kind selected from the group consisting of ethylene glycol, propylene glycol, trimethylene glycol, tetraethylene glycol, polyethylene glycol, diethylene glycol, glycerin, and polypropylene glycol.

Besides, the present invention provides a method for producing nickel microparticle, wherein the method uses at least two fluids to be processed, of these, at least one fluid to be processed is a nickel compound fluid in which a nickel compound is dissolved in a solvent, the nickel compound fluid contains a sulfate ion, at least one fluid to be processed other than the foregoing fluid to be processed is a reducing agent fluid in which a reducing agent is dissolved in a solvent, at least any one fluid to be processed of the nickel compound fluid and the reducing agent fluid contains a polyol, these fluids to be processed are mixed in a thin film fluid formed between at least two processing surfaces which are disposed in a position they are faced with each other so as to be able to approach to and separate from each other, at least one of which rotates relative to the other, whereby the nickel microparticle is separated, concentration of the polyol contained in at least any one fluid to be processed of the nickel compound fluid and the reducing agent fluid that are introduced into between the at least two processing surfaces and also a molar ratio of the sulfate ion relative to the nickel contained in the nickel compound fluid are controlled, whereby controlling a ratio d/D, a ratio of crystallite's diameter (d) of the nickel microparticle relative to particle diameter (D) of the nickel microparticle.

In addition, the present invention may be executed as an embodiment, wherein the nickel compound fluid contains the polyol, the polyol is ethylene glycol and polyethylene glycol, when the molar ratio of the sulfate ion relative to the nickel contained in the nickel compound fluid is 1.24, concentration of the polyol in the nickel compound fluid is controlled so as to be higher thereby making the ratio d/D higher, and when the molar ratio of the sulfate ion relative to the nickel contained in the nickel compound fluid is 1.00, concentration of the polyol in the nickel compound fluid is controlled so as to be higher thereby making the ratio d/D lower.

In addition, the present invention may be executed as an embodiment, wherein the nickel compound is a hydrate of nickel sulfate.

In addition, the present invention may be executed as an embodiment, wherein a first processing surface and a second processing surface are provided as the at least two processing surfaces, the fluids to be processed are introduced between the first processing surface and the second processing surfaces, by a pressure of the fluids to be processed, a force to move the second processing surface in a direction to separate it from the first processing surface is generated, by this force, a very narrow space is kept between the first processing surface and the second processing surface, and the fluids to be processed which pass through this narrow space that is kept between the first processing surface and the second processing surface which form the thin film fluid.

In addition, the present invention may be executed as an embodiment, wherein the nickel compound fluid goes through between the at least two processing surfaces while forming the thin film fluid, a separate introduction path independent of the flow path through which the nickel compound fluid runs is arranged, at least one opening which is connected to the separate introduction path is arranged in at least any one of the at least two processing surfaces, and the reducing agent fluid is introduced through this opening into between the at least two processing surfaces, whereby the nickel compound fluid and the reducing agent fluid are mixed in the thin film fluid.

According to mere one embodiment of the present invention, the present invention may be carried out as a method for producing a microparticle, wherein the method comprises:

a fluid pressure imparting mechanism for imparting a pressure to a fluid to be processed, a first processing member provided with a first processing surface of the at least two processing surfaces, a second processing member provided with a second processing surface of the at least two processing surfaces, and a rotation drive mechanism for rotating these processing members relative to each other; wherein each of the processing surfaces constitutes part of a sealed flow path through which the fluid to be processed under the pressure is passed, of the first and the second processing members, at least the second processing member is provided with a pressure-receiving surface, and at least part of this pressure-receiving surface is comprised of the second processing surface, the pressure-receiving surface receives a pressure applied to the fluid to be processed by the fluid pressure imparting mechanism thereby generating a force to move in the direction of separating the second processing surface from the first processing surface, the fluid to be processed under the pressure is passed between the first processing surface and the second processing surface which are disposed in a position they are faced with each other so as to be able to approach to and separate from each other, at least one of which rotates relative to the other, whereby the fluid to be processed forms a thin film fluid, in this thin film fluid, whereby separating nickel microparticle as a method for producing nickel microparticle.

Advantages

According to the present invention, it became possible to control the ratio of the crystallite's diameter relative to the particle diameter of the nickel microparticle, this having been difficult by the conventional liquid phase method, and in addition, the nickel microparticle having the ratio of the crystallite's diameter relative to the particle diameter controlled can be produced continuously.

In addition, according to the present invention, the ratio of the crystallite's diameter relative to the particle diameter of the nickel microparticle can be controlled by a simple change of the process condition which involves control of the pH of the nickel compound fluid and the molar ratio of the sulfate ion relative to the nickel contained in the nickel compound fluid, thereby the nickel microparticle can be selectively produced in accordance with the purpose thereof with lower cost and energy than ever, so that the nickel microparticle can be provided cheaply and stably.

Furthermore, the present invention can provide the nickel microparticle having a desired particle diameter with an intended physical property.

BRIEF DESCRIPTION OF DRAWINGS

FIG. 2(B) is an enlarged view showing an important part of the processing surface in the apparatus.

BEST MODES FOR CARRYING OUT THE INVENTION

Figure 1:
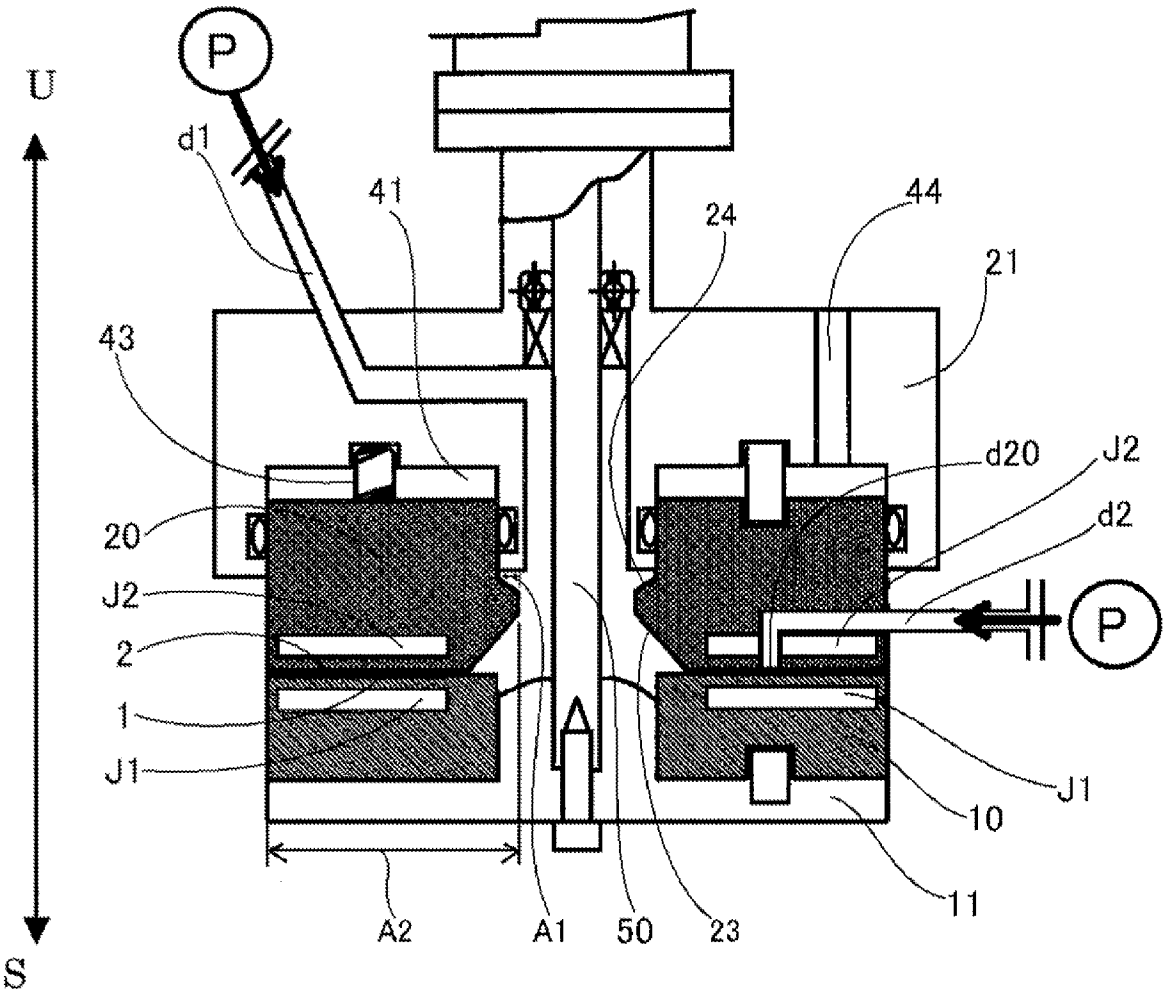
FIG. 1 is a schematic sectional view showing the fluid processing apparatus according to an embodiment of the present invention.

Hereunder, explanation will be made based on the figures by taking up one example of the embodiment of the present invention.

The nickel compound fluid of the present invention is the one having a nickel compound dissolved or molecular-dispersed in a solvent, and also the nickel compound fluid contains a sulfate ion.

The reducing agent fluid of the present invention is the one having a reducing agent dissolved or molecular-dispersed in a solvent (hereinafter, this is simply referred to as "dissolved").

In addition, a polyol is contained in at least any one of the nickel compound fluid and the reducing agent fluid.

The nickel compound to be used may be various nickel compounds including nickel sulfate, nickel nitrate, nickel chloride, basic nickel carbonate, and hydrates of them; among them, nickel sulfate which can serve also as the source of the sulfate ion (this will be mentioned later) is preferable. These nickel compounds may be used solely or as a combination of two or more of them.

The reducing agent is not particularly restricted. Illustrative example thereof includes hydrazine, hydrazine monohydrate, hydrazine sulfate, formaldehyde sodium sulfoxylate, a boron hydride metal salt, an aluminum hydride metal salt, a triethylboron hydride metal salt, glucose, citric acid, ascorbic acid, tannic acid, dimethylformamide, tetrabutylammonium borohydride, sodium hypophosphite ($NaH_2PO_2.H_2O$) may be used. These reducing agent may be used solely or as a combination of two or more of them.

In the case when a reducing agent which requires securing of a certain pH region for the reduction activity, such as for example, hydrazine and hydrazine monohydrate is used, a pH-controlling substance may be used together with this reducing agent. Illustrative example of the pH-controlling substance includes inorganic or organic acidic substances such as hydrochloric acid, sulfuric acid, nitric acid, aqua regia, trichloroacetic acid, trifluoroacetic acid, phosphoric acid, citric acid, and ascorbic acid; alkali hydroxides such as sodium hydroxide and potassium hydroxide; basic substances such as amines including triethylamine and dimethylamino ethanol; and salts of these acidic substances and basic substances. These pH-controlling substances may be used solely or as a combination of two or more of them.

The solvent to be used for a raw material fluid and separating fluid in the present invention is not particularly restricted; and illustrative example thereof includes water such as an ion-exchanged water, a RO water, a pure water, and a ultrapure water; alcoholic organic solvents such as methanol and ethanol; polyol organic solvents (polyvalent alcohols) such as ethylene glycol, propylene glycol, trimethylene glycol, triethylene glycol, polyethylene glycol, and glycerin; ketonic organic solvents such as acetone and methyl ethyl ketone; ester organic solvents such as ethyl acetate and butyl acetate; ether organic solvents such as dimethyl ether and dibutyl ether; aromatic organic solvents such as benzene, toluene, and xylene; and aliphatic hydrocarbon organic solvents such as hexane and pentane. If the foregoing alcoholic organic solvents or polyol solvents (polyvalent alcohols) are used as the solvent, there is a merit that these solvents can act also as the reducing substance; particularly it is effective in the case of producing a nickel microparticle. These solvents each may be used solely or as a combination of two or more of them.

In the present invention, a polyol is contained in at least any one of the nickel compound fluid and the reducing agent fluid. The polyol is an alcohol having a valency of divalent or a higher valency; and illustrative example thereof includes ethylene glycol, propylene glycol, trimethylene glycol, tetraethylene glycol, diethylene glycol, glycerin, polyethylene glycol, and polypropylene glycol. These polyols may be used solely or as a combination of two or more of them.

In the present invention, the nickel microparticle is obtained by the polyol reduction method in which the nickel ion is reduced by using the above-mentioned reducing agent and polyol together.

In the present invention, the sulfate ion is contained in the nickel compound fluid. Illustrative example of the source of the sulfate ion includes, besides sulfuric acid, sulfate salts of sodium sulfate, potassium sulfate, ammonium sulfate, or their hydrates and organic solvates. The afore-mentioned hydrazine sulfate can act as the reducing agent as well as the source of the sulfate ion. Hereunder, the source of the sulfate ion other than nickel sulfate is referred to as the sulfate compound.

In the present invention, the nickel compound fluid contains the sulfate ion; and by changing the concentration thereof, the molar ratio of the sulfate ion relative to the nickel contained in the nickel compound fluid can be changed. At the same time with this, pH of the nickel compound fluid can be changed; however, pH of the nickel compound fluid may also be adjusted separately by using the afore-mentioned pH-controlling substance. And then, during the time when the nickel compound fluid and the reducing agent fluid are mixed by the way as mentioned later, by controlling pH of the nickel compound fluid as well as the molar ratio of the sulfate ion relative to the nickel contained in the nickel compound fluid, the ratio of d/D, i.e., the ratio of the crystallite's diameter (d) relative to the particle diameter (D) of the nickel microparticle to be produced, may be controlled. Applicant of the present invention presumes that the sulfate ion has a function to control the particle growth of the nickel microparticle whereby helping the growth of the crystallite thereof; and as a result, by controlling pH of the nickel compound fluid as well as the molar ratio of the sulfate ion relative to the nickel contained in the nickel compound fluid, the ratio d/D of the crystallite's diameter (d) relative to the particle diameter (D) of the nickel microparticle to be obtained could be controlled. Here, the nickel contained in the nickel compound fluid means all the nickel contained in the nickel compound fluid regardless of the states thereof including a nickel ion and a nickel complex ion.

In order to well control the ratio of the crystallite's diameter relative to the particle diameter of the nickel microparticle, the molar ratio of the sulfate ion relative to the nickel contained in the nickel compound fluid is preferably more than 1.00. In this regard, it is preferable to use nickel sulfate or a hydrate thereof as the nickel compound because this contains both the nickel ion and the sulfate ion equally. Depending on the solvent used for dissolving the nickel compound, if a sulfate compound is added excessively to increase the molar ratio of the sulfate ion relative to the nickel contained in the nickel compound fluid, the sulfate ion and the nickel ion in the nickel compound fluid interact; and as a result, for example, deposit such as, for example, nickel sulfate may be separated. It is important to have a proper balance between the molar ratio of the sulfate ion relative to the nickel contained in the nickel compound fluid and the solubilities of the solvent to the nickel compound and to the sulfate compound.

As discussed above, in the present invention, during the time when the nickel compound fluid and the reducing agent fluid are mixed by the way as mentioned later, by controlling pH of the nickel compound fluid and the molar ratio of the sulfate ion relative to the nickel contained in the nickel compound fluid, the ratio of the crystallite's diameter relative to the particle diameter of the nickel microparticle to be obtained can be controlled. The pH of the nickel compound fluid may be changed by changing the concentration of the nickel sulfate contained in the nickel compound fluid, for example, by changing the concentration of nickel sulfate, the nickel compound, and the concentration of the sulfate compound contained in the nickel compound fluid; and besides, pH of the nickel compound fluid may be adjusted separately by using the afore-mentioned pH-controlling substance. By changing the concentration of the sulfate ion contained in the nickel compound fluid, not only the concentration of the sulfate ion in the nickel compound fluid but also pH therein may be changed.

In the present invention, in order to well control the ratio of the crystallite's diameter relative to the particle diameter of the nickel microparticle, pH of the nickel compound fluid at room temperature needs to be acidic; and further, pH of the nickel compound fluid at room temperature is preferably 4.4 or lower, or more preferably 4.1 or lower. Meanwhile, the operation including preparation of the fluids and mixing thereof for this control may be carried out at room temperature; however, even when the operation is carried out under the environment other than at room temperature, it may be allowed as far as the above-mentioned condition of pH at room temperature is fulfilled.

In the present invention, pH of the reducing agent fluid is not particularly restricted. It may be arbitrarily chosen in accordance with the reducing agent, the concentration thereof, and so forth.

Alternatively, the afore-mentioned sulfate compound may be added to the reducing agent fluid.

During the time when the nickel compound fluid and the reducing agent fluid are mixed by the method as mentioned later, this operation is carried out preferably as following: the control is made so as to obtain a higher d/D ratio, i.e., the ratio of the crystallite's diameter (d) relative to the particle diameter (D) of the nickel microparticle to be obtained, by raising the molar ratio of the sulfate ion relative to the nickel contained in the nickel compound fluid while pH of the nickel compound fluid at room temperature is being kept constant in an acidic condition; and the control is made so as to obtain lower d/D ratio by lowering the molar ratio of the sulfate ion relative to the nickel contained in the nickel compound fluid while pH of the nickel compound fluid at room temperature is being kept constant in an acidic condition. Meanwhile, the operation including preparation of the fluids and mixing thereof for this control may be carried out at room temperature; however, even when the operation is carried out under the environment other than at room temperature, it may be allowed as far as the condition that pH of the nickel compound fluid at room temperature is kept constant in an acidic condition is fulfilled.

In addition, during the time when the nickel compound fluid and the reducing agent fluid are mixed by the method as mentioned later, as the nickel compound fluid, it is preferable that the nickel compound fluid having 4.1 or lower in its pH at room temperature and also having more than 1.0 in the molar ratio of the sulfate ion relative to the nickel contained in the nickel compound fluid be used. This is preferable in order to obtain the nickel microparticle having the ratio d/D of 0.30 or more, preferably 0.35 or more, or more preferably 0.40 or more, and the crystallite's diameter (d) of 30 nm or more, preferably 35 nm or more, or more preferably 40 nm or more.

Furthermore, during the time when the nickel compound fluid and the reducing agent fluid are mixed by the method as mentioned later, in order to obtain the nickel microparticle having the crystallite's diameter (d) of 30 nm or more, as the nickel compound fluid, it is preferable that the nickel compound fluid having pH in the range of 4.1 or higher to 4.4 or lower and also having more than 1.1 in the molar ratio of the sulfate ion relative to the nickel contained in the nickel compound fluid be used; and in order to obtain the nickel microparticle having 0.30 or more in the ratio d/D, as the nickel compound fluid, it is preferable that the nickel compound fluid having pH in the range of 4.1 or higher to 4.4 or lower and also having more than 1.2 in the molar ratio of the sulfate ion relative to the nickel contained in the nickel compound fluid be used. Meanwhile, the operation including preparation of these fluids and mixing thereof for this control may be carried out at room temperature; however, even when the operation is carried out under the environment other than at room temperature, it may be allowed as far as the above-mentioned condition of pH at room temperature is fulfilled.

The nickel microparticle having the ratio d/D of 0.30 or more and the nickel microparticle having the crystallite's diameter of 30 nm or more are suitable for the ceramic condenser, because the shrinkage after heat-treatment can be suppressed in these microparticles.

Dispersant, Etc.:

In the present invention, in accordance with the purpose and the necessity thereof, various kinds of dispersant and surfactant may be used. There are no particular restrictions on them, so that generally used various surfactants and dispersants that are commercially available goods and products, newly synthesized substances, or the like may be used. Anionic surfactants, cationic surfactant, nonionic surfactants, and various polymer dispersants may be exemplified for them, though not limited to these surfactants and dispersants. These may be used solely or as a combination of two or more of them. When polyethylene glycol, polypropylene glycol, or the like is used as the polyol, these polyols can function as the dispersants as well.

During the time when the nickel compound fluid and the reducing agent fluid are mixed by the method as mentioned later, the ratio of d/D, i.e., the ratio of the crystallite's diameter (d) relative to the particle diameter (D) of the nickel microparticle to be obtained, may be controlled by controlling the molar ratio of the sulfate ion relative to the nickel contained in the nickel compound fluid and also by controlling the concentration of polyol that can function also as the dispersant and is contained in at least any one of the nickel compound fluid and the reducing agent fluid.

In this case, the polyol that can function also as the dispersant is preferably contained in the nickel compound fluid; and when the molar ratio of the sulfate ion relative to the nickel contained in the nickel compound fluid is 1.24, the control is made so as to give the higher d/D ratio by increasing the concentration of the polyol that can function also as the dispersant in the nickel compound fluid; on the other hand, when the molar ratio of the sulfate ion relative to the nickel contained in the nickel compound fluid is 1.00, the control is made so as to give the lower d/D ratio by increasing the concentration of the polyol that can function also as the dispersant in the nickel compound fluid.

The nickel compound fluid and the reducing agent fluid may be used even if these include the state of solid and crystal such as a dispersion solution and a slurry of them.

In the present invention, it is preferable to use the method wherein the nickel compound fluid and the reducing agent fluid are mixed in the thin film fluid formed between at least two processing surfaces which are disposed in a position they are faced with each other so as to be able to approach to and separate from each other, at least one of which rotates relative to the other; and thus, for example, it is preferable to mix these fluids thereby separating the nickel microparticle by using the apparatus based on the same principle as the apparatus shown in Patent Document 4.

Hereinafter, embodiments of the above-mentioned fluid processing apparatus will be explained by using the drawings.

Figure 2:
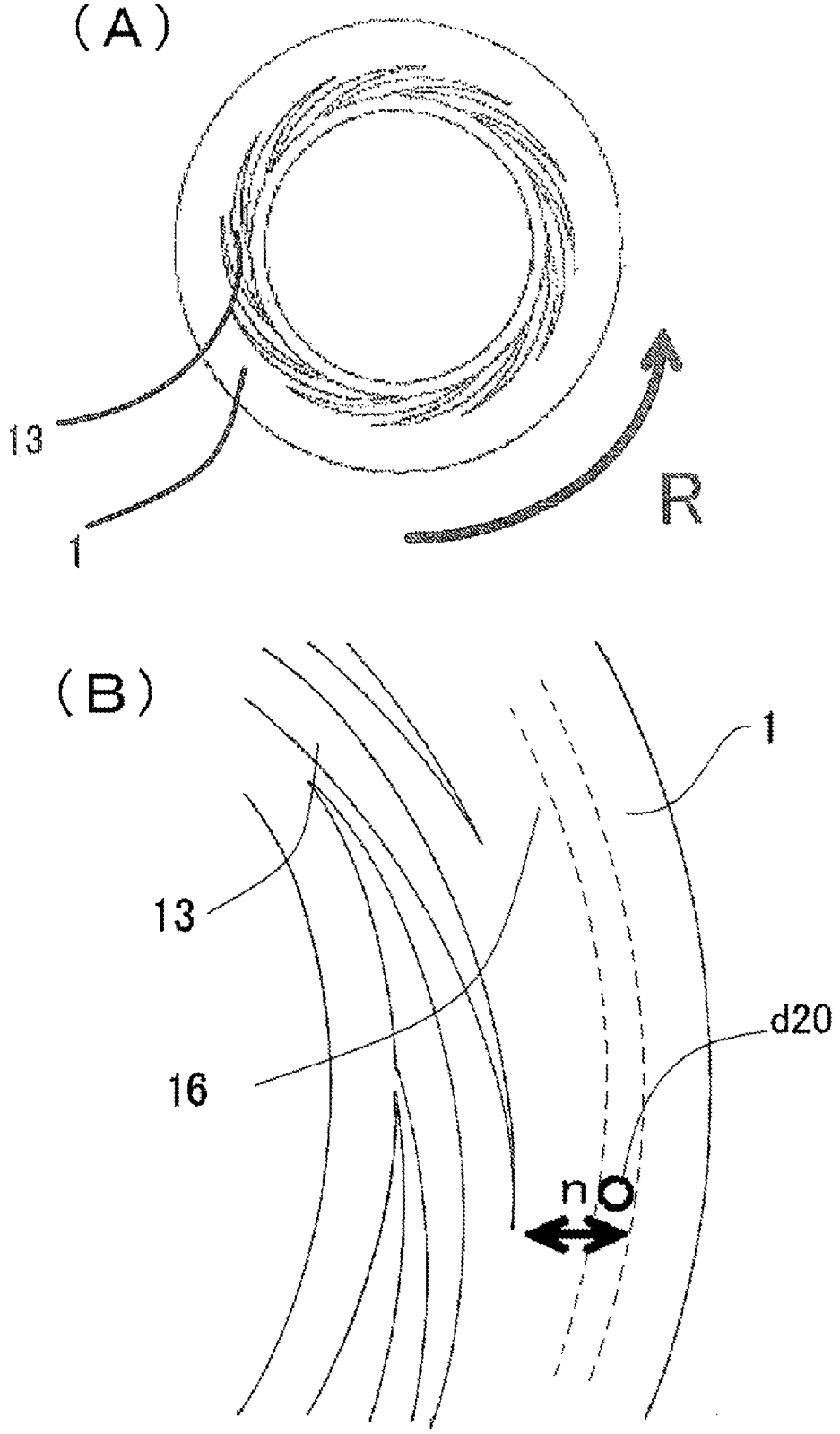
FIG. 2 (A) is a schematic plane view of the first processing surface in the fluid processing apparatus shown in FIG. 1.
Figure 3:
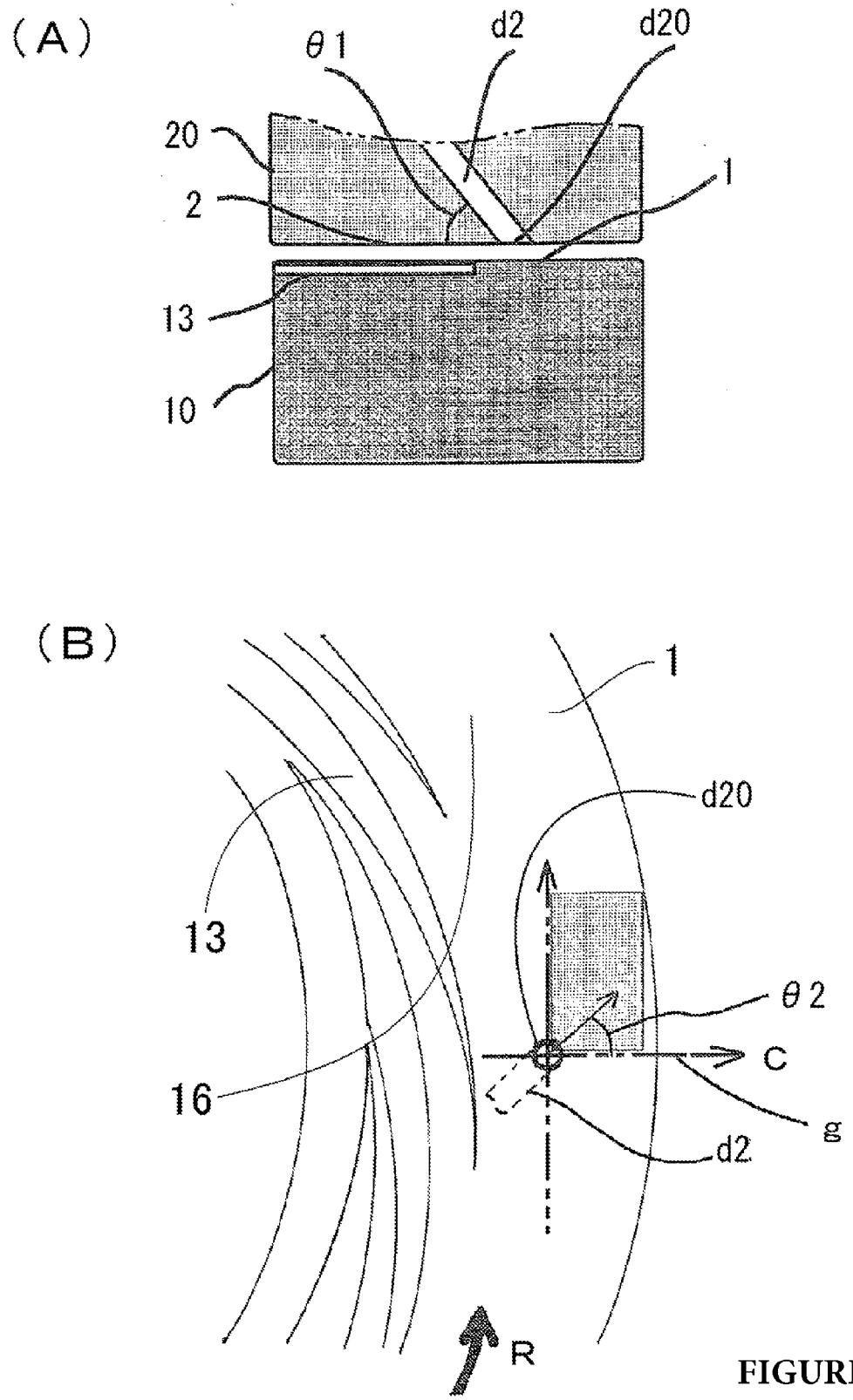
FIG. 3(A) is a sectional view of the second introduction member of the apparatus.
FIG. 3(B) is an enlarged view showing an important part of the processing surface for explaining the second introduction member.

The fluid processing apparatus shown in FIG. 1 to FIG. 3 which a material to be processed is processed between processing surfaces in processing members arranged so as to be able to approach to and separate from each other, at least one of which rotates relative to the other; wherein, of the fluids to be processed, a first fluid to be processed, i.e., a first fluid, is introduced into between the processing surfaces, and a second fluid to be processed, i.e., a second fluid, is introduced into between the processing surfaces from a separate path that is independent of the flow path introducing the first fluid and has an opening leading to between the processing surfaces, whereby the first fluid and the second fluid are mixed and stirred between the processing surfaces. Meanwhile, in FIG. 1, a reference character U indicates an upside and a reference character S indicates a downside; however, up and down, front and back and right and left shown therein indicate merely a relative positional relationship and does not indicate an absolute position. In FIG. 2(A) and FIG. 3(B), reference character R indicates a rotational direction. In FIG. 3(C), reference character C indicates a direction of centrifugal force (a radial direction).

In this apparatus provided with processing surfaces arranged opposite to each other so as to be able to approach to and separate from each other, at least one of which rotates relative to the other, at least two kinds of fluids as fluids to be processed are used, wherein at least one fluid thereof contains at least one kind of material to be processed, a thin film fluid is formed by converging the respective fluids between these processing surfaces, and the material to be processed is processed in this thin film fluid. With this apparatus, a plurality of fluids to be processed may be processed as mentioned above; but a single fluid to be processed may be processed as well.

This fluid processing apparatus is provided with two processing members of a first processing member 10 and a second processing member 20 arranged opposite to each other, wherein at least one of these processing members rotates. The surfaces arranged opposite to each other of the respective processing members 10 and 20 are made to be the respective processing surfaces. The first processing member 10 is provided with a first processing surface 1 and the second processing member 20 is provided with a second processing surface 2.

The processing surfaces 1 and 2 are connected to a flow path of the fluid to be processed and constitute part of the flow path of the fluid to be processed. Distance between these processing surfaces 1 and 2 can be changed as appropriate; and thus, the distance thereof is controlled so as to form a minute space usually in the range of 1 mm or less, for example, 0.1 μm to 50 μm. With this, the fluid to be processed passing through between the processing surfaces 1 and 2 becomes a forced thin film fluid forced by the processing surfaces 1 and 2.

When a plurality of fluids to be processed are processed by using this apparatus, the apparatus is connected to a flow path of the first fluid to be processed whereby forming part of the flow path of the first fluid to be processed; and part of the flow path of the second fluid to be processed other than the first fluid to be processed is formed. In this apparatus, the two paths converge into one, and two fluids to be processed are mixed between the processing surfaces 1 and 2 so that the fluids may be processed by reaction and so on. It is noted here that the term "process(ing)" includes not only the embodiment wherein a material to be processed is reacted but also the embodiment wherein a material to be processed is only mixed or dispersed without accompanying reaction.

To specifically explain, this apparatus is provided with a first holder 11 for holding the first processing member 10, a second holder 21 for holding the second processing member 20, a surface-approaching pressure imparting mechanism, a rotation drive mechanism, a first introduction part d1, a second introduction part d2, and a fluid pressure imparting mechanism p.

As shown in FIG. 2(A), in this embodiment, the first processing member 10 is a circular body, specifically a disk with a ring form. Similarly, the second processing member 20 is a circular disk. Material of the processing members 10 and 20 is not only metal and carbon but also ceramics, sintered metal, abrasion-resistant steel, sapphire, and other metal subjected to hardening treatment, and rigid material subjected to lining, coating, or plating. In the processing members 10 and 20 of this embodiment, at least part of the first and the second surfaces 1 and 2 arranged opposite to each other is mirror-polished.

Roughness of this mirror polished surface is not particularly limited; but surface roughness Ra is preferably 0.01 μm to 1.0 μm, or more preferably 0.03 μm to 0.3 μm.

At least one of the holders can rotate relative to the other holder by a rotation drive mechanism such as an electric motor (not shown in drawings). A reference numeral 50 in FIG. 1 indicates a rotary shaft of the rotation drive mechanism; in this embodiment, the first holder 11 attached to this rotary shaft 50 rotates, and thereby the first processing member 10 attached to this first holder 11 rotates relative to the second processing member 20. As a matter of course, the second processing member 20 may be made to rotate, or the both may be made to rotate. Further in this embodiment, the first and second holders 11 and 21 may be fixed, while the first and second processing members 10 and 20 may be made to rotate relative to the first and second holders 11 and 21.

At least any one of the first processing member 10 and the second processing member 20 is able to approach to and separate from at least any other member, thereby the processing surfaces 1 and 2 are able to approach to and separate from each other.

In this embodiment, the second processing member 20 approaches to and separates from the first processing member 10, wherein the second processing member 20 is accepted in an accepting part 41 arranged in the second holder 21 so as to be able to rise and set. However, as opposed to the above, the first processing member 10 may approach to and separate from the second processing member 20, or both the processing members 10 and 20 may approach to and separate from each other.

This accepting part 41 is a concave portion for mainly accepting that side of the second processing member 20 opposite to the second processing surface 2, and this concave portion is a groove being formed into a circle, i.e., a ring when viewed in a plane. This accepting part 41 accepts the second processing member 20 with sufficient clearance so that the second processing member 20 may rotate. Meanwhile, the second processing member 20 may be arranged so as to be movable only parallel to the axial direction; alternatively, the second processing member 20 may be made movable, by making this clearance larger, relative to the accepting part 41 so as to make the center line of the processing member 20 inclined, namely unparallel, to the axial direction of the accepting part 41, or movable so as to depart the center line of the processing member 20 and the center line of the accepting part 41 toward the radius direction.

It is preferable that the second processing member 20 be accepted by a floating mechanism so as to be movable in the three dimensional direction, as described above.

The fluids to be processed are introduced into between the processing surfaces 1 and 2 from the first introduction part d1 and the second introduction part d2, the flow paths through which the fluids flow, under the state that pressure is applied thereto by a fluid pressure imparting mechanism p consisting of various pumps, potential energy, and so on. In this embodiment, the first introduction part d1 is a path arranged in the center of the circular, second holder 21, and one end thereof is introduced into between the processing surfaces 1 and 2 from inside the circular, processing members 10 and 20. Through the second introduction part d2, the first fluid to be processed and the second fluid to be processed for reaction are introduced into between the processing surfaces 1 and 2. In this embodiment, the second introduction part d2 is a path arranged inside the second processing member 20, and one end thereof is open at the second processing surface 2. The first fluid to be processed which is pressurized with the fluid pressure imparting mechanism p is introduced from the first introduction part d1 to the space inside the processing members 10 and 20 so as to pass through between the first and processing surfaces 1 and 2 to outside the processing members 10 and 20. From the second introduction part d2, the second fluid to be processed which is pressurized with the fluid pressure imparting mechanism p is provided into between the processing surfaces 1 and 2, whereat this fluid is converged with the first fluid to be processed, and there, various fluid processing such as mixing, stirring, emulsification, dispersion, reaction, deposition, crystallization, and separation are effected, and then the fluid thus processed is discharged from the processing surfaces 1 and 2 to outside the processing members 10 and 20. Meanwhile, an environment outside the processing members 10 and 20 may be made negative pressure by a vacuum pump.

The surface-approaching pressure imparting mechanism mentioned above supplies the processing members with force exerting in the direction of approaching the first processing surface 1 and the second processing surface 2 each other. In this embodiment, the surface-approaching pressure imparting mechanism is arranged in the second holder 21 and biases the second processing member 20 toward the first processing member 10.

The surface-approaching pressure imparting mechanism is a mechanism to generate force (hereinafter, surface-approaching pressure) to press the first processing surface 1 of the first processing member 10 and the second processing surface 2 of the second processing member 20 in the direction to make them approach to each other. The mechanism generates a thin film fluid having minute thickness in a level of nanometer or micrometer by the balance between the surface-approaching pressure and the force to separate the processing surfaces 1 and 2 from each other, i.e., the force such as the fluid pressure. In other words, the distance between the processing surfaces 1 and 2 is kept in a predetermined minute distance by the balance between these forces.

In the embodiment shown in FIG. 1, the surface-approaching pressure imparting mechanism is arranged between the accepting part 41 and the second processing member 20. Specifically, the surface-approaching pressure imparting mechanism is composed of a spring 43 to bias the second processing member 20 toward the first processing member 10 and a biasing-fluid introduction part 44 to introduce a biasing fluid such as air and oil, wherein the surface-approaching pressure is provided by the spring 43 and the fluid pressure of the biasing fluid. The surface-approaching pressure may be provided by any one of this spring 43 and the fluid pressure of this biasing fluid; and other forces such as magnetic force and gravitation may also be used. The second processing member 20 recedes from the first processing member 10 thereby making a minute space between the processing surfaces by separating force, caused by viscosity and the pressure of the fluid to be processed applied by the fluid pressure imparting mechanism p, against the bias of this surface-approaching pressure imparting mechanism. By this balance between the surface-approaching pressure and the separating force as mentioned above, the first processing surface 1 and the second processing surface 2 can be set with the precision of a micrometer level; and thus the minute space between the processing surfaces 1 and 2 may be set. The separating force mentioned above includes fluid pressure and viscosity of the fluid to be processed, centrifugal force by rotation of the processing members, negative pressure when negative pressure is applied to the biasing-fluid introduction part 44, and spring force when the spring 43 works as a pulling spring. This surface-approaching pressure imparting mechanism may be arranged also in the first processing member 10, in place of the second processing member 20, or in both the processing members.

To specifically explain the separation force, the second processing member 20 has the second processing surface 2 and a separation controlling surface 23 which is positioned inside the processing surface 2 (namely at the entering side of the fluid to be processed into between the first and second processing surfaces 1 and 2) and next to the second processing surface 2. In this embodiment, the separation controlling surface 23 is an inclined plane, but may be a horizontal plane. The pressure of the fluid to be processed acts to the separation controlling surface 23 to generate force directing to separate the second processing member 20 from the first processing member 10. Therefore, the second processing surface 2 and the separation controlling surface 23 constitute a pressure receiving surface to generate the separation force.

In the example shown in FIG. 1, an approach controlling surface 24 is formed in the second processing member 20. This approach controlling surface 24 is a plane opposite, in the axial direction, to the separation controlling surface 23 (upper plane in FIG. 1) and, by action of pressure applied to the fluid to be processed, generates force of approaching the second processing member 20 toward the first processing member 10.

Meanwhile, the pressure of the fluid to be processed exerted on the second processing surface 2 and the separation controlling surface 23, i.e., the fluid pressure, is understood as force constituting an opening force in a mechanical seal. The ratio (area ratio A1/A2) of a projected area A1 of the approach controlling surface 24 projected on a virtual plane perpendicular to the direction of approaching and separating the processing surfaces 1 and 2, that is, in the direction of rising and setting of the second processing member 20 (axial direction in FIG. 1), to a total area A2 of the projected area of the second processing surface 2 of the second processing member 20 and the separation controlling surface 23 projected on the virtual plane is called as balance ratio K, which is important for control of the opening force. This opening force can be controlled by the pressure of the fluid to be processed, i.e., the fluid pressure, by changing the balance line, i.e., by changing the area A1 of the approach controlling surface 24.

Sliding surface actual surface pressure P, i.e., the fluid pressure out of the surface-approaching pressures, is calculated according to the following equation:

$$P=P1\times(K-k)+Ps$$

Here, P1 represents the pressure of a fluid to be processed, i.e., the fluid pressure, K represents the balance ratio, k represents an opening force coefficient, and Ps represents a spring and back pressure.

By controlling this balance line to control the sliding surface actual surface pressure P, the space between the processing surfaces 1 and 2 is formed as a desired minute space, thereby forming a fluid film of the fluid to be processed so as to make the processed substance such as a product fine and to effect uniform processing by reaction.

Meanwhile, the approach controlling surface 24 may have a larger area than the separation controlling surface 23, though this is not shown in the drawing.

The fluid to be processed becomes a forced thin film fluid by the processing surfaces 1 and 2 that keep the minute space therebetween, whereby the fluid is forced to move out from the circular, processing surfaces 1 and 2. However, the first processing member 10 is rotating; and thus, the mixed fluid to be processed does not move linearly from inside the circular, processing surfaces 1 and 2 to outside thereof, but does move spirally from the inside to the outside thereof by a resultant vector acting on the fluid to be processed, the vector being composed of a moving vector toward the radius direction of the circle and a moving vector toward the circumferential direction.

Meanwhile, a rotary shaft 50 is not only limited to be placed vertically, but may also be placed horizontally, or at a slant. This is because the fluid to be processed is processed in a minute space between the processing surfaces 1 and 2 so that the influence of gravity can be substantially eliminated. In addition, this surface-approaching pressure imparting mechanism can function as a buffer mechanism of micro-vibration and rotation alignment by concurrent use of the foregoing floating mechanism with which the second processing member 20 may be held displaceably.

In the movement of fluid, the dimensionless number which expresses the ratio of inertia force to viscosity force is called as Reynolds number, which is expressed by the following equation.

$$\text{Reynolds number Re=inertia force/viscosity force}=\rho VL/\mu=VL/\nu$$

Here, $\nu=\mu/\rho$ shows dynamic viscosity, V shows representative velocity, L shows representative length, $\rho$ shows density, and $\mu$ shows viscosity.

Flow of the fluid changes at the borderline of the critical Reynolds number; namely below the critical Reynolds number is the laminar flow, while above the critical Reynolds number is the turbulent flow.

Because the space between the processing surfaces 1 and 2 of the fluid processing apparatus is controlled so narrow that amount of the fluid that kept between the processing surfaces 1 and 2 is extremely small. Therefore, the representative length L is very short, so that the centrifugal force of the thin film fluid which passes through between the processing surfaces 1 and 2 is so small that the effect of the viscosity force in the thin film fluid becomes large. Accordingly the Reynolds number becomes smaller so that the thin film fluid becomes the laminar flow.

The centrifugal force, one of the inertia forces in rotation movement, is a force acting from a center to an outside. The centrifugal force can be expressed by the following equation.

$$\text{Centrifugal force } F=ma=mv^2/R$$

Here, "a" shows acceleration, "m" shows mass, "v" shows velocity, and R shows radius.

As mentioned above, amount of the fluid kept between the processing surfaces 1 and 2 is so small so that the ratio of the velocity relative to the fluid mass becomes very large, so that the said mass can be neglected. Accordingly, the effect of gravity can be neglected in the thin film fluid formed between the processing surfaces 1 and 2. Because of this, a microparticle of an alloy or a composite metal compound which contains two or more metal elements having different specific gravities can be separated in the thin film fluid formed between the processing surfaces 1 and 2, even though these are intrinsically difficult to be separated as the microparticle.

In the first and second processing members 10 and 20, the temperature thereof may be controlled by cooling or heating at least any one of them; in FIG. 1, an embodiment having temperature regulating mechanisms J1 and J2 in the first and second processing members 10 and 20 is shown. Alternatively, the temperature may be regulated by cooling or heating the introducing fluid to be processed. These temperatures may be used to separate the processed substance or may be set so as to generate Benard convection or Marangoni convection in the fluid to be processed between the first and second processing surfaces 1 and 2.

As shown in FIG. 2, in the first processing surface 1 of the first processing member 10, a groove-like depression 13 extended toward an outer side from the central part of the first processing member 10, namely in a radius direction, may be formed. The depression 13 may be, as a plane view, curved or spirally extended on the first processing surface 1 as shown in FIG. 2(B), or, though not shown in the drawing, may be extended straight radially, or bent at a right angle, or jogged; and the concave portion may be continuous, intermittent, or branched. In addition, this depression 13 may be formed also on the second processing surface 2, or on both the first and second processing surfaces 1 and 2. By forming the depression 13 as mentioned above, the micro-pump effect can be obtained so that the fluid to be processed may be sucked into between the first and second processing surfaces 1 and 2.

It is preferable that the base edge of this depression 13 reach the inner periphery of the first processing member 10. The front edge of the depression 13 is extended to the direction of the outer periphery of the first processing surface 1; the depth thereof (cross section area) is made gradually shallower (smaller) from the base edge to the front edge.

Between the front edge of the depression 13 and the outer peripheral of the first processing surface 1 is formed the flat plane 16 not having the depression 13.

When an opening d20 of the second introduction part d2 is arranged in the second processing surface 2, the arrangement is done preferably at a position opposite to the flat surface 16 of the first processing surface 1 arranged at a position opposite thereto.

This opening d20 is arranged preferably in the downstream (outside in this case) of the depression 13 of the first processing surface 1. The opening is arranged especially preferably at a position opposite to the flat surface 16 located nearer to the outer diameter than a position where the direction of flow upon introduction by the micro-pump effect is changed to the direction of a spiral and laminar flow formed between the processing surfaces. Specifically, in FIG. 2(B), a distance n from the outermost side of the depression 13 arranged in the first processing surface 1 in the radial direction is preferably about 0.5 mm or more. Especially in the case of separating microparticles from a fluid, it is preferable that mixing of a plurality of fluids to be processed and separation of the microparticles therefrom be effected under the condition of a laminar flow. Shape of the opening part d20 may be circular as shown by the solid lines in FIG. 2(B) and FIG. 3(B), or a concentric circular ring shape which encloses the central opening of the processing surface 2 having a form of a ring-like disk as shown by the dotted lines in FIG. 2(B). The opening part d20 with the circular ring shape may not be necessarily arranged in the way that it encircles concentrically around the central opening of the processing surface 2. In the case that the opening part is made in the circular ring shape, the opening part having the circular ring shape may be continuous or discontinuous.

If the opening part d20 having the circular ring shape is arranged in the way that it encircles concentrically around the central opening of the processing surface 2, the second fluid that is introduced into between the processing surfaces 1 and 2 can be introduced under the same condition, so that the fluid processing including diffusion, reaction, and separation may be done more uniformly. If the microparticle is wanted to be produced in large quantity, the shape of the opening part is preferably made in the circular ring shape.

This second introduction part d2 may have directionality. For example, as shown in FIG. 3(A), the direction of introduction from the opening d20 of the second processing surface 2 is inclined at a predetermined elevation angle (θ1) relative to the second processing surface 2. The elevation angle (θ1) is set at more than 0° and less than 90°, and when the reaction speed is high, the angle (θ1) is preferably set in the range of 1° to 45°.

In addition, as shown in FIG. 3(B), introduction from the opening d20 of the second processing surface 2 has directionality in a plane along the second processing surface 2. The direction of introduction of this second fluid is in the outward direction departing from the center in a radial component of the processing surface and in the forward direction in a rotation component of the fluid between the rotating processing surfaces. In other words, a predetermined angle (θ2) exists facing the rotation direction R from a reference line g, which is the line to the outward direction and in the radial direction passing through the opening d20. This angle (θ2) is also set preferably at more than 0° and less than 90°.

This angle (θ2) can vary depending on various conditions such as the type of fluid, the reaction speed, viscosity, and the rotation speed of the processing surface. In addition, it is also possible not to give the directionality to the second introduction part d2 at all.

In the embodiment shown in FIG. 1, kinds of the fluid to be processed and numbers of the flow path thereof are set two respectively; but they may be one, or three or more. In the embodiment shown in FIG. 1, the second fluid is introduced into between the processing surfaces 1 and 2 from the introduction part d2; but this introduction part may be arranged in the first processing member 10 or in both. Alternatively, a plurality of introduction parts may be arranged relative to one fluid to be processed. The opening for introduction arranged in each processing member is not particularly restricted in its form, size, and number; and these may be changed as appropriate. The opening for introduction may be arranged just before the first and second processing surfaces 1 and 2 or in the side of further upstream thereof.

Meanwhile, because it is good enough only if the reaction could be effected between the processing surfaces 1 and 2, as opposed to the foregoing method, a method wherein the second fluid is introduced from the first introduction part d1 and a solution containing the first fluid is introduced from the second introduction part d2 may also be used. That is, the expression "first" or "second" for each fluid has a meaning for merely discriminating an $n^{th}$ fluid among a plurality of the fluids present; and therefore, a third or more fluids can also exist.

In the above-mentioned fluid processing apparatus, a treatment such as separation/precipitation and crystallization is effected while the fluids are being mixed forcibly and uniformly between the processing surfaces 1 and 2 which are disposed in a position they are faced with each other so as to be able to approach to and separate from each other, at least one of which rotates relative to the other, as shown in FIG. 1. Particle diameter and monodispersity of the treated substance to be processed can be controlled by appropriately controlling rotation speed of the processing members 10 and 20, distance between the processing surfaces 1 and 2, concentration of raw materials in the fluids to be processed, kind of solvents in the fluids to be processed, and so forth.

Hereunder, specific embodiments as to the method for producing nickel microparticles by using the above-mentioned apparatus will be explained.

In the fluid processing apparatus as discussed above, the nickel compound fluid and the reducing agent fluid are mixed in the thin film fluid formed between the processing surfaces 1 and 2 which are disposed in a position they are faced with each other so as to be able to approach to and separate from each other, at least one of which rotates relative to the other, whereby the nickel microparticle is separated. During this time, the sulfate ion is contained in the nickel compound fluid, and the polyol is contained in at least anyone of the fluids to be processed, i.e., the nickel compound fluid and the reducing agent fluid, whereby pH of the nickel compound fluid and the molar ratio of the sulfate ion relative to the nickel contained in the nickel compound fluid that is introduced into between the processing surfaces 1 and 2 are controlled. Further, the sulfate ion is contained in the nickel compound fluid, and the polyol is contained in at least anyone of the fluids to be processed, i.e., the nickel compound fluid and the reducing agent fluid, so that the concentration of the polyol contained in at least any one of the fluids to be processed that are introduced into between the processing surfaces 1 and 2, i.e., the nickel compound fluid and the reducing agent fluid, as well as the molar ratio of the sulfate ion relative to the nickel contained in the nickel compound fluid may be controlled.

The separation of the nickel microparticles takes place in the apparatus as shown in FIG. 1 of the present application while the fluids are being mixed forcibly and uniformly between the processing surfaces 1 and 2 which are disposed in a position they are faced with each other so as to be able to approach to and separate from each other, at least one of which rotates relative to the other.

At first, the nickel compound fluid is introduced as the first fluid from the first introduction part d1, which is one flow path, into between the processing surfaces 1 and 2 which are disposed in a position they are faced with each other so as to be able to approach to and separate from each other, at least one of which rotates relative to the other, thereby forming between the processing surfaces a first fluid film which is a thin film fluid formed of the first fluid.

Next, from the second introduction part d2, which is the separate flow path, the reducing agent fluid is introduced as the second fluid directly into the first fluid film formed between the processing surfaces 1 and 2.

By so doing, the first fluid and the second fluid are mixed between the processing surfaces 1 and 2 while the distance therebetween is fixed by pressure balance between the supply pressure of the fluids to be processed and the pressure that is applied between the rotating processing surfaces, thereby separating the nickel microparticles.

As mentioned before, the processing apparatus may be provided with, in addition to the first introduction part d1 and the second introduction part d2, the third introduction part d3; and in this case, for example, each of the first fluid, the second fluid, and the third fluid may be introduced respectively into the processing apparatus. By so doing, concentration and pressure of each fluid can be controlled separately so that the separation reaction and particle diameter of the microparticles may be controlled more precisely. Meanwhile, a combination of the fluids to be processed (first to third fluids) that are introduced into each of the introduction parts may be set arbitrarily. The same is applied if the fourth or more introduction parts are arranged; and by so doing, fluids to be introduced into the processing apparatus may be subdivided. In addition, temperatures of the fluids to be processed such as the first fluid and the second fluid may be controlled; and temperature difference among the first fluid, the second fluid, and so on (namely, temperature difference among each of the supplied fluids to be processed) may be controlled either. To control temperature and temperature difference of each of the supplied fluids to be processed, a mechanism with which temperature of each of the fluids to be processed is measured (temperature of the fluid before introduction to the processing apparatus, or in more detail, just before introduction into between the processing surfaces 1 and 2) so that each of the fluids to be processed that is introduced into between the processing surfaces 1 and 2 may be heated or cooled may be installed.

Temperature:

In the present invention, the temperature at the time when the nickel compound fluid and the reducing agent fluid are mixed is not particularly restricted. Arbitrary temperature may be chosen in accordance with the kinds of the nickel compound and of the reducing agent, pH of the fluids, and the like.

EXAMPLES

Hereinafter, the present invention will be explained in more detail by Examples; but the present invention is not limited only to these Examples.

It is to be noted here that the term "from the center" in the following Examples means "from the first introduction part d1" of the fluid processing apparatus shown in FIG. 1; the first fluid means the first fluid to be processed that is introduced through the first introduction part d1 of the processing apparatus as described before; and the second fluid means the second fluid to be processed that is introduced through the second introduction part d2 of the processing apparatus shown in FIG. 1, as described before.

In addition, the opening part d20 of the second introduction part d2 having a concentric circular ring shape which encloses the central opening of the processing surface 2 as shown by the dotted lines in FIG. 2(B) was used.

Separation of the Nickel Microparticle:

By using the fluid processing apparatus shown in FIG. 1, the nickel compound fluid and the reducing agent fluid are mixed in the thin film fluid formed between the processing surfaces 1 and 2 which are disposed in a position they are faced with each other so as to be able to approach to and separate from each other, at least one of which rotates relative to the other, whereby the nickel microparticle is separated in this thin film fluid.

Specifically, from the center, the nickel compound fluid is supplied as the first fluid with the supply pressure of 0.50 MPaG. The first fluid is supplied to the closed space formed between the processing surface 1 of the processing member 10 and the processing surface 2 of the processing member 20 (between the processing surfaces) in FIG. 1. The rotation number of the processing member 10 is 3,600 rpm. The first fluid forms the forced thin film fluid between the processing surfaces 1 and 2, and then it is discharged from the circumferences of the processing members 10 and 20. The reducing agent fluid is introduced as the second fluid directly into the thin film fluid formed between the processing surfaces 1 and 2. The nickel compound fluid and the reducing agent fluid are mixed between the processing surfaces 1 and 2, the space therebetween being controlled so as to be a very narrow distance, whereby the nickel microparticle is separated. The slurry which contains the nickel microparticle (nickel microparticle dispersion solution) is discharged from between the processing surfaces 1 and 2.

Method for Recovering the Microparticle:

The nickel microparticle dispersion solution that was discharged from between the processing surfaces 1 and 2 was placed on a magnet to settle the nickel microparticle down; and after the supernatant solution was removed, the washing operation thereof by pure water was repeated for three times, and then the wet cake thus obtained was dried under the atmospheric pressure at 25° C. to obtain the dry powder of the nickel microparticle.

Measurement of pH of the first fluid and the second fluid as well as the analysis of the dry powder of the nickel microparticle was done as follows.

Measurement of pH:

Measurement of pH was done by using the pH meter (Type D-51, manufactured by HORIBA, Ltd.). Before each of the fluids to be processed was introduced into the fluid processing apparatus, pH of each of the fluids to be processed was measured at room temperature.

Observation by the Scanning Electron Microscope:

Observation by the scanning electron microscope (SEM) was done by using the field-emission-type scanning electron microscope (FE-SEM) (JSM-7500F, manufactured by JEOL Ltd.). The observation condition with the magnification of 10,000 or more was used, wherein the average value of the particle diameters of 100 nickel microparticles obtained by the SEM observation was taken as the primary particle diameter.

Measurement of the X-Ray Diffraction:

Measurement of the X-ray diffraction (XRD) was made by using the powder X-ray diffraction measurement instrument X'pert PRO MPD (XRD; manufactured by Panalytical Business Unit of Spectris Co., Ltd.). The measurement conditions were as follows: Cu anticathode, tube voltage of 45 kV, tube current of 40 mA, 0.016 step/10 second, and the measurement range of 10 to 100°/2θ (Cu). The crystallite's diameter of the obtained nickel microparticle was calculated from the XRD measurement. The peak confirmed at 47.3° C. was used for the polycrystalline silicon plate, and the Scherrer's equation was applied to the peak appeared near to 44.5° in the obtained nickel diffraction pattern.

ICP Analysis—Detection of Impure Elements:

Quantitative analysis of the elements contained in the dry powder of the nickel microparticle by the inductively coupled plasma atomic emission spectrophotometry (ICP) was carried out by using ICPS-8100 (manufactured by Shimadzu Corp.).

The solution in which the dry powder of the nickel microparticle was dissolved in nitric acid was used for the measurement. In all of Examples and Comparative Examples, all the elements other than the nickel element were outside the detection limit.

Examples 1 to 17

The nickel compound fluid having the composition shown in Table 1 and the reducing agent fluid having the composition shown in Table 2 were mixed to separate the nickel microparticle under the treatment condition shown in Table 3 by using the fluid processing apparatus shown in FIG. 1. The dry powder of the obtained nickel microparticle was analyzed. These results are shown in Table 4. Meanwhile, the supply pressure of the first fluid and the rotation number of the processing member 10 were those as mentioned before. In all of Examples 1 to 17, the nickel microparticle disperse solution discharged from the processing surfaces 1 and 2 showed a basicity.

In Examples 1 to 14, the nickel compound fluid was prepared as follows: nickel sulfate hexahydrate was dissolved in the mixed solvent comprising ethylene glycol, polyethylene glycol 600, and pure water, and in order to change pH and concentration of the sulfate ion, sulfuric acid, ammonium sulfate, or potassium sulfate was added separately as the sulfate compound. In Examples 15 to 17, the nickel compound fluid was obtained by following the same procedure as Examples 1 to 14, except that polyvinyl pyrrolidone (k=30) was used in place of polyethylene glycol 600.

The abbreviations used in Table 1 to Table 16 are as follows: $NiSO_4.6H_2O$; nickel sulfate hexahydrate, EG; ethylene glycol, PEG 600; polyethylene glycol 600, PVP (k=30); polyvinyl pyrrolidone, PW; pure water, HMH; hydrazine monohydrate, KOH; potassium hydroxide, $H_2SO_4$; sulfuric acid, $(NH_4)_2SO_4$; ammonium sulfate, $K_2SO_4$; potassium sulfate, $HNO_3$; nitric acid, $KNO_3$; potassium nitrate, $CH_3COOH$; acetic acid, $CH_3COOK$; potassium acetate, $SO_4^{2-}$; sulfate ion, and $CH_3COO^-$; acetate ion.

TABLE 1

| | First fluid: Composition | | | | | | | | |
|---|---|---|---|---|---|---|---|---|---|
| | EG | PEG 600 | PVP (k = 30) | PW | $NiSO_4 \cdot 6H_2O$ | $H_2SO_4$ | $(NH_4)_2SO_4$ | $K_2SO_4$ | |
| Example | Concentration (% by weight) | | | | Concentration (mol/L) | | | | pH |
| 1 | 81 | 0.8 | 0.0 | 13 | 0.20 | 0.0000 | 0.0000 | 0.0000 | 4.1 |
| 2 | 81 | 0.8 | 0.0 | 13 | 0.20 | 0.0000 | 0.0000 | 0.0049 | 4.1 |
| 3 | 81 | 0.8 | 0.0 | 13 | 0.20 | 0.0008 | 0.0000 | 0.0275 | 4.1 |
| 4 | 80 | 0.8 | 0.0 | 13 | 0.20 | 0.0035 | 0.0000 | 0.0014 | 3.1 |
| 5 | 80 | 0.8 | 0.0 | 13 | 0.20 | 0.0073 | 0.0000 | 0.0483 | 3.1 |
| 6 | 80 | 0.8 | 0.0 | 13 | 0.20 | 0.0073 | 0.0000 | 0.0483 | 3.1 |
| 7 | 81 | 0.8 | 0.0 | 13 | 0.20 | 0.0049 | 0.0000 | 0.0000 | 3.0 |
| 8 | 81 | 0.8 | 0.0 | 13 | 0.20 | 0.0061 | 0.0000 | 0.0222 | 3.0 |
| 9 | 81 | 0.8 | 0.0 | 13 | 0.20 | 0.0484 | 0.0000 | 0.0000 | 2.0 |
| 10 | 81 | 0.8 | 0.0 | 13 | 0.20 | 0.0754 | 0.0000 | 0.0210 | 2.0 |
| 11 | 80 | 1.6 | 0.0 | 13 | 0.20 | 0.0484 | 0.0000 | 0.0000 | 1.7 |
| 12 | 80 | 1.6 | 0.0 | 13 | 0.20 | 0.0831 | 0.0133 | 0.0000 | 1.7 |
| 13 | 80 | 0.8 | 0.0 | 13 | 0.20 | 0.0964 | 0.0000 | 0.0000 | 1.4 |
| 14 | 80 | 0.8 | 0.0 | 13 | 0.20 | 0.1213 | 0.0133 | 0.0000 | 1.4 |
| 15 | 80 | 0.0 | 0.1 | 13 | 0.30 | 0.0320 | 0.0000 | 0.0000 | 2.2 |
| 16 | 73 | 0.0 | 0.1 | 17 | 0.39 | 0.0420 | 0.0000 | 0.0000 | 2.2 |
| 17 | 64 | 0.0 | 0.1 | 26 | 0.39 | 0.0580 | 0.0000 | 0.0000 | 1.7 |

TABLE 2

| Second fluid: Composition | | | |
|---|---|---|---|
| Concentration (% by weight) | | | |
| HMH | KOH | PW | pH |
| 70.00 | 10.00 | 20.00 | 14< |

TABLE 3

| | First fluid | | Second fluid | |
|---|---|---|---|---|
| Example | Supply flow rate (mL/minute) | Supply temperature (° C.) | Supply flow rate (mL/minute) | Supply temperature (° C.) |
| 1 | 400 | 135 | 30 | 30 |
| 2 | 400 | 135 | 30 | 30 |
| 3 | 400 | 135 | 30 | 30 |

TABLE 3-continued

| | First fluid | | Second fluid | |
|---|---|---|---|---|
| Example | Supply flow rate (mL/minute) | Supply temperature (° C.) | Supply flow rate (mL/minute) | Supply temperature (° C.) |
| 4 | 400 | 137 | 40 | 30 |
| 5 | 400 | 137 | 35 | 30 |
| 6 | 400 | 137 | 50 | 30 |
| 7 | 400 | 133 | 30 | 30 |
| 8 | 400 | 133 | 30 | 30 |
| 9 | 400 | 136 | 35 | 30 |
| 10 | 400 | 136 | 50 | 30 |
| 11 | 400 | 154 | 30 | 30 |
| 12 | 400 | 154 | 35 | 30 |
| 13 | 400 | 155 | 50 | 30 |
| 14 | 800 | 149 | 100 | 30 |
| 15 | 400 | 154 | 52.5 | 30 |
| 16 | 800 | 155 | 140 | 30 |
| 17 | 400 | 155 | 80 | 30 |

TABLE 4

| Example | First fluid pH | $SO_4^{2-}$/Ni | Crystallite diameter d (nm) | Particle diameter D (nm) | d/D |
|---|---|---|---|---|---|
| 1 | 4.1 | 1.00 | 26.4 | 129.3 | 0.20 |
| 2 | 4.1 | 1.02 | 30.8 | 100.9 | 0.31 |
| 3 | 4.1 | 1.14 | 32.1 | 99.8 | 0.32 |
| 4 | 3.1 | 1.02 | 47.2 | 149.3 | 0.32 |
| 5 | 3.1 | 1.28 | 50.5 | 152.3 | 0.33 |
| 6 | 3.1 | 1.28 | 39.9 | 119.8 | 0.33 |
| 7 | 3.0 | 1.02 | 30.1 | 91.1 | 0.33 |
| 8 | 3.0 | 1.14 | 31.2 | 85.4 | 0.37 |
| 9 | 2.0 | 1.24 | 37.7 | 79.4 | 0.47 |
| 10 | 2.0 | 1.49 | 32.3 | 80.3 | 0.54 |
| 11 | 1.7 | 1.24 | 34.9 | 98.7 | 0.35 |
| 12 | 1.7 | 1.49 | 35.6 | 74.2 | 0.48 |
| 13 | 1.4 | 1.49 | 35.6 | 101.2 | 0.35 |
| 14 | 1.4 | 1.67 | 55.6 | 118.4 | 0.47 |
| 15 | 2.2 | 1.11 | 49.9 | 111.5 | 0.45 |
| 16 | 2.2 | 1.11 | 48.0 | 121.5 | 0.40 |
| 17 | 1.7 | 1.15 | 41.5 | 80.6 | 0.51 |

From Table 4, it was confirmed that by controlling the molar ratio of $SO_4^{2-}$/Ni, i.e., the molar ratio of the sulfate ion relative to the nickel contained in the first fluid, the growth of the crystallite's diameter could be facilitated while suppressing the growth of the particle diameter of the separated nickel microparticle. In addition, it was confirmed that the growth of the particle diameter could be suppressed as the crystallite's diameter grew. Accordingly, it was confirmed that the ratio d/D, i.e., the ratio of the crystallite's diameter relative to the particle diameter of the nickel microparticle, could be controlled.

In Examples 1 to 17, pH of the first fluid was 4.1 or lower. In the case that pH of the first fluid was 4.1 or lower, it was confirmed that by controlling the molar ratio of $SO_4^{2-}$/Ni, i.e., the molar ratio of the sulfate ion relative to the nickel contained in the first fluid, so as to be more than 1.0, the nickel microparticle having the ratio d/D of 0.30 or more and the crystallite's diameter (d) of 30 nm or more could be produced. In the nickel microparticle having the ratio d/D of 0.30 or more and the nickel microparticle having the crystallite's diameter of 30 nm or more, the shrinkage after heat-treatment can be suppressed; and thus, it was confirmed the nickel microparticle that is suitable for the ceramic condenser could be produced.

Furthermore, in Examples 15 to 18 in which polyethylene glycol 600 used in Examples 1 to 14 was replaced by polyvinyl pyrrolidone (k=30), the similar results as Examples 1 to 14 were obtained.

In Examples 1 to 14, in the case when pH of the first fluid was identical, it was found that by raising the molar ratio of $SO_4^{2-}$/Ni, i.e., the molar ratio of the sulfate ion relative to the nickel contained in the first fluid, the ratio of d/D could be made larger; while by lowering the molar ratio of $SO_4^{2-}$/Ni, i.e., the molar ratio of the sulfate ion relative to the nickel contained in the first fluid, the ratio of d/D could be made smaller.

Examples 18 to 23

The dry powder of the nickel microparticle was obtained by following the procedure of Examples 1 to 17, except that the composition of the nickel compound fluid was changed as shown in Table 5 and the process condition was changed as shown in Table 6. These results are shown in Table 7. In all of Examples 15 to 23, the nickel microparticle disperse solution discharged from the processing surfaces 1 and 2 showed a basicity.

TABLE 5

| | First fluid: Composition | | | | | | | |
|---|---|---|---|---|---|---|---|---|
| Example | EG | PEG 600 | PW | $NiSO_4 \cdot 6H_2O$ | $H_2SO_4$ | $(NH_4)_2SO_4$ | $K_2SO_4$ | pH |
| | Concentration (% by weight) | | | Concentration (mol/L) | | | | |
| 18 | 81 | 0.8 | 13 | 0.20 | 0.0000 | 0.0283 | 0.0000 | 4.2 |
| 19 | 81 | 0.8 | 13 | 0.20 | 0.0015 | 0.0000 | 0.0468 | 4.2 |
| 20 | 81 | 0.8 | 13 | 0.20 | 0.0000 | 0.0000 | 0.0283 | 4.4 |
| 21 | 81 | 0.8 | 13 | 0.20 | 0.0000 | 0.0000 | 0.0483 | 4.4 |
| 22 | 81 | 0.8 | 13 | 0.20 | 0.0000 | 0.0000 | 0.0483 | 4.6 |
| 23 | 81 | 0.8 | 13 | 0.20 | 0.0000 | 0.0000 | 0.0483 | 4.7 |

TABLE 6

| | First fluid | | Second fluid | |
|---|---|---|---|---|
| Example | Supply flow rate (mL/minute) | Supply temperature (° C.) | Supply flow rate (mL/minute) | Supply temperature (° C.) |
| 18 | 400 | 137 | 50 | 30 |
| 19 | 400 | 137 | 30 | 30 |
| 20 | 400 | 137 | 50 | 30 |
| 21 | 400 | 137 | 35 | 30 |
| 22 | 400 | 155 | 50 | 30 |
| 23 | 800 | 148 | 60 | 30 |

TABLE 7

| Example | First fluid pH | Molar ratio $SO_4^{2-}$/Ni | Crystallite diameter d (nm) | Particle diameter D (nm) | d/D |
|---|---|---|---|---|---|
| 18 | 4.2 | 1.14 | 42.3 | 153.3 | 0.28 |
| 19 | 4.2 | 1.24 | 38.5 | 123.4 | 0.31 |
| 20 | 4.4 | 1.14 | 38.3 | 141.2 | 0.27 |
| 21 | 4.4 | 1.24 | 53 | 172.9 | 0.31 |
| 22 | 4.6 | 1.24 | 36.9 | 150.0 | 0.25 |
| 23 | 4.7 | 1.24 | 22.6 | 149.0 | 0.15 |

From Table 7, it was confirmed that by controlling the molar ratio of $SO_4^{2-}$/Ni, i.e., the molar ratio of the sulfate ion relative to the nickel contained in the first fluid, the growth of the crystallite's diameter could be facilitated while suppressing the growth of the particle diameter of the separated nickel microparticle. In addition, it was confirmed that the growth of the particle diameter could be suppressed as the crystallite's diameter grew. Accordingly, it was confirmed that the ratio d/D, i.e., the ratio of the crystallite's diameter relative to the particle diameter of the nickel microparticle, could be controlled.

In Examples 18 to 23, pH of the first fluid was in the range of higher than 4.1 to 4.7 or lower. In the case that pH of the first fluid was in the range of higher than 4.1 to 4.4 or lower, it was confirmed that by controlling the molar ratio of $SO_4^{2-}$/Ni, i.e., the molar ratio of the sulfate ion relative to the nickel contained in the first fluid, so as to be more than 1.2, the nickel microparticle having the ratio d/D of 0.30 or more could be obtained. In addition, in the case that pH of the first fluid was in the range of higher than 4.1 to 4.4 or lower, it was confirmed that by controlling the molar ratio of $SO_4^{2-}$/Ni, i.e., the molar ratio of the sulfate ion relative to the nickel contained in the first fluid, so as to be more than 1.1, the nickel microparticle having the crystallite's diameter of 30 nm or more could be produced.

In Examples 18 to 23, in the case when pH of the first fluid was identical, it was found that by increasing the molar ratio of $SO_4^{2-}$/Ni, i.e., the molar ratio of the sulfate ion relative to the nickel contained in the first fluid, the ratio of d/D could be made larger; while by lowering the molar ratio of $SO_4^{2-}$/Ni, i.e., the molar ratio of the sulfate ion relative to the nickel contained in the first fluid, the ratio of d/D could be made smaller.

Comparative Examples 1 to 7

The dry powder of the nickel microparticle was obtained by following the procedure of Examples 1 to 17, except that the composition of the nickel compound fluid was changed as shown in Table 8 and the process condition was changed as shown in Table 9. These results are shown in Table 10. In all of Comparative Examples 1 to 7, the nickel microparticle dispersion solution discharged from the processing surfaces 1 and 2 showed a basicity.

The nickel compound fluid was prepared as follows: nickel sulfate hexahydrate was dissolved in the mixed solvent comprising ethylene glycol, polyethylene glycol 600, and pure water, and in order to change only pH, nitric acid and/or potassium nitrate was added separately.

TABLE 8

| Comparative Example | First fluid: Composition | | | | | | | | | |
|---|---|---|---|---|---|---|---|---|---|---|
| | EG | PEG 600 | PW | $NiSO_4 \cdot 6H_2O$ | $H_2SO_4$ | $(NH_4)_2SO_4$ | $K_2SO_4$ | $HNO_3$ | $KNO_3$ | pH |
| | Concentration (% by weight) | | | Concentration (mol/L) | | | | | | |
| 1 | 80 | 0.8 | 13 | 0.20 | 0.0000 | 0.0000 | 0.0000 | 0.0480 | 0.0000 | 1.98 |
| 2 | 80 | 0.8 | 13 | 0.20 | 0.0000 | 0.0000 | 0.0000 | 0.0988 | 0.0000 | 1.74 |
| 3 | 80 | 0.8 | 13 | 0.20 | 0.0000 | 0.0000 | 0.0000 | 0.0480 | 0.0000 | 1.98 |
| 4 | 80 | 0.8 | 13 | 0.20 | 0.0000 | 0.0000 | 0.0000 | 0.0988 | 0.0000 | 1.74 |
| 5 | 80 | 0.8 | 13 | 0.20 | 0.0000 | 0.0000 | 0.0000 | 0.0240 | 0.0240 | 3.11 |
| 6 | 80 | 0.8 | 13 | 0.20 | 0.0000 | 0.0000 | 0.0000 | 0.0000 | 0.0480 | 4.19 |
| 7 | 80 | 0.8 | 13 | 0.20 | 0.0000 | 0.0000 | 0.0000 | 0.0000 | 0.0988 | 4.38 |

TABLE 9

| Comparative Example | First fluid | | Second fluid | |
|---|---|---|---|---|
| | Supply flow rate (mL/minute) | Supply temperature (° C.) | Supply flow rate (mL/minute) | Supply temperature (° C.) |
| 1 | 400 | 135 | 40 | 30 |
| 2 | 400 | 136 | 50 | 30 |
| 3 | 400 | 154 | 40 | 30 |
| 4 | 400 | 152 | 50 | 30 |
| 5 | 400 | 153 | 40 | 30 |
| 6 | 400 | 151 | 40 | 30 |
| 7 | 400 | 153 | 40 | 30 |

TABLE 10

| Comparative Example | First fluid pH | $SO_4^{2-}$/Ni | Molar ratio $NO_3^-$/Ni | Crystallite diameter d (nm) | Particle diameter D (nm) | d/D |
|---|---|---|---|---|---|---|
| 1 | 1.98 | 1.00 | 0.24 | 34.3 | 205.4 | 0.17 |
| 2 | 1.74 | 1.00 | 0.49 | 35.9 | 224.1 | 0.16 |
| 3 | 1.98 | 1.00 | 0.24 | 28.9 | 124.5 | 0.23 |
| 4 | 1.74 | 1.00 | 0.49 | 27.5 | 112.3 | 0.24 |
| 5 | 3.11 | 1.00 | 0.24 | 21.1 | 101.1 | 0.21 |
| 6 | 4.19 | 1.00 | 0.24 | 18.6 | 94.6 | 0.20 |
| 7 | 4.38 | 1.00 | 0.49 | 16.7 | 87.6 | 0.19 |

From Table 10, in Comparative Examples 1 to 2, in which pH of the first fluid was 4.1 or lower, the supply temperature thereof was 135° C.±2° C., and the molar ratio of $SO_4^{2-}$/Ni, i.e., the molar ratio of the sulfate ion relative to the nickel contained in the first fluid, was made constant at 1.00, the crystallite's diameter (d) of the nickel microparticle obtained therein became 30 nm or more; however, at the same time, the particle diameter (D) thereof was increased as well, so that the ratio of d/D was significantly lower than 0.30. Further, in Comparative Examples 3 to 5, in which pH of the first fluid was 4.1 or lower, the supply temperature thereof was 153° C.±2° C., and the molar ratio of $SO_4^{2-}$/Ni, i.e., the molar ratio of the sulfate ion relative to the nickel contained in the first fluid, was made constant at 1.00, the crystallite's diameter (d) of the nickel microparticle obtained therein was less than 30 nm, and the ratio of d/D was less than 0.30. Further, in Comparative Examples 6 to 7, in which pH of the first fluid was in the range of more than 4.1 to 4.4 or lower, the supply temperature thereof was 153° C.±2° C., and the molar ratio of $SO_4^{2-}$/Ni, i.e., the molar ratio of the sulfate ion relative to the nickel contained in the first fluid, was made constant at 1.00, the crystallite's diameter (d) of the nickel microparticle obtained therein was less than 30 nm, and the ratio of d/D was less than 0.30. Even when the molar ratio of the total of sulfate ion and the nitrate ion relative to the nickel contained in the first fluid was more than 1.20, the ratio of d/D did not become 0.30 or more.

It was confirmed that the ratio of d/D could not be controlled by changing only pH of the first fluid while the molar ratio of $SO_4^{2-}$/Ni, i.e., the molar ratio of the sulfate ion relative to the nickel contained in the first fluid, was being kept constant at 1.00.

Comparative Examples 8 to 12

The dry powder of the nickel microparticle was obtained by following the procedure of Examples 1 to 17, except that the composition of the nickel compound fluid was changed as shown in Table 11 and the process condition was changed as shown in Table 12. These results are shown in Table 13. In all of Comparative Examples 8 to 12, the nickel microparticle dispersion solution discharged from the processing surfaces 1 and 2 showed a basicity.

The nickel compound fluid was prepared as follows: nickel sulfate hexahydrate was dissolved in the mixed solvent comprising ethylene glycol, polyethylene glycol 600, and pure water, and in order to change only pH, acetic acid and/or potassium acetate was added separately.

TABLE 11

| Comparative Example | First fluid: Composition | | | | | | | | | |
|---|---|---|---|---|---|---|---|---|---|---|
| | EG | PEG 600 | PW | $NiSO_4 \cdot 6H_2O$ | $H_2SO_4$ | $(NH_4)_2SO_4$ | $K_2SO_4$ | $CH_3COOH$ | $CH_3COOK$ | |
| | Concentration (% by weight) | | | Concentration (mol/L) | | | | | | pH |
| 8 | 80 | 0.8 | 13 | 0.20 | 0.0000 | 0.0000 | 0.0000 | 0.0480 | 0.0000 | 3.63 |
| 9 | 80 | 0.8 | 13 | 0.20 | 0.0000 | 0.0000 | 0.0000 | 0.0988 | 0.0000 | 3.04 |
| 10 | 80 | 0.8 | 13 | 0.20 | 0.0000 | 0.0000 | 0.0000 | 0.0240 | 0.0240 | 3.91 |
| 11 | 80 | 0.8 | 13 | 0.20 | 0.0000 | 0.0000 | 0.0000 | 0.0000 | 0.0480 | 4.22 |
| 12 | 80 | 0.8 | 13 | 0.20 | 0.0000 | 0.0000 | 0.0000 | 0.0000 | 0.0988 | 4.39 |

TABLE 12

| Comparative Example | First fluid | | Second fluid | |
|---|---|---|---|---|
| | Supply flow rate (mL/minute) | Supply temperature (° C.) | Supply flow rate (mL/minute) | Supply temperature (° C.) |
| 8 | 400 | 153 | 40 | 30 |
| 9 | 400 | 151 | 50 | 30 |
| 10 | 400 | 155 | 40 | 30 |
| 11 | 400 | 152 | 40 | 30 |
| 12 | 400 | 153 | 50 | 30 |

TABLE 13

| Comparative Example | First fluid pH | $SO_4^{2-}/Ni$ | Molar ratio $CH_3COO^-/Ni$ | Crystallite diameter d (nm) | Particle diameter D (nm) | d/D |
|---|---|---|---|---|---|---|
| 8 | 3.63 | 1.00 | 0.24 | 32.4 | 154.6 | 0.21 |
| 9 | 3.04 | 1.00 | 0.49 | 33.1 | 178.6 | 0.19 |
| 10 | 3.91 | 1.00 | 0.24 | 32.9 | 136.8 | 0.24 |
| 11 | 4.22 | 1.00 | 0.24 | 19.8 | 114.6 | 0.17 |
| 12 | 4.39 | 1.00 | 0.49 | 18.7 | 108.7 | 0.17 |

From Table 13, in Comparative Examples 8, 9, and 10, in which pH of the first fluid was 4.1 or lower, the supply temperature thereof was 153° C.±2° C., and the molar ratio of $SO_4^{2-}/Ni$, i.e., the molar ratio of the sulfate ion relative to the nickel contained in the first fluid, was made constant at 1.00, the crystallite's diameter (d) of the nickel microparticle obtained therein was 30 nm or more; however, the particle diameter (D) thereof was increased simultaneously, so that the ratio of d/D was significantly lower than 0.30. Further, in Comparative Examples 11 to 12, in which pH of the first fluid was in the range of higher than 4.1 to 4.4 or lower, the supply temperature thereof was 153° C.±2° C., and the molar ratio of $SO_4^{2-}/Ni$, i.e., the molar ratio of the sulfate ion relative to the nickel contained in the first fluid, was made constant at 1.00, the crystallite's diameter (d) of the nickel microparticle obtained therein was less than 30 nm, and the ratio of d/D was less than 0.30. When the molar ratio of the total of sulfate ion and the acetate ion relative to the nickel contained in the first fluid was more than 1.20, the ratio of d/D did not become 0.3 or more.

It was confirmed that the ratio of d/D could not be controlled by changing only pH of the first fluid while the molar ratio of $SO_4^{2-}/Ni$, i.e., the molar ratio of the sulfate ion relative to the nickel contained in the first fluid, was being kept constant at 1.00.

Examples 24 to 31

The nickel compound fluid having the composition shown in Table 14 and the reducing agent fluid having the composition shown in Table 15 were mixed under the treatment condition shown in Table 16 by using the fluid processing apparatus shown in FIG. 1 to separate the nickel microparticle. The dry powder of the obtained nickel microparticle was analyzed. These results are shown in Table 17. Meanwhile, the supply pressure of the first fluid and the rotation number of the processing member 10 were those as mentioned before. In all of Examples 24 to 31, the nickel microparticle dispersion solution discharged from the processing surfaces 1 and 2 showed a basicity.

The nickel compound fluid was prepared as follows: nickel sulfate hexahydrate was dissolved in the mixed solvent comprising ethylene glycol, polyethylene glycol 600, and pure water, wherein in Examples 24 to 28 the same amount of sulfuric acid was added separately, and in Examples 29 to 31, sulfuric acid was not added. In each of Examples 24 to 28 and Examples 29 to 31, the concentration of polyethylene glycol 600 contained in the nickel compound fluid was changed.

TABLE 14

| Example | First fluid: Composition | | | | | | | |
|---|---|---|---|---|---|---|---|---|
| | EG | PEG 600 | PW | $NiSO_4 \cdot 6H_2O$ | $H_2SO_4$ | $(NH_4)_2SO_4$ | $K_2SO_4$ | pH |
| | Concentration (% by weight) | | | Concentration (mol/L) | | | | |
| 24 | 81 | 0.0 | 13 | 0.20 | 0.0484 | 0.0000 | 0.0000 | 1.9 |
| 25 | 81 | 0.4 | 13 | 0.20 | 0.0484 | 0.0000 | 0.0000 | 2.0 |
| 26 | 81 | 0.8 | 13 | 0.20 | 0.0484 | 0.0000 | 0.0000 | 2.0 |
| 27 | 81 | 1.2 | 13 | 0.20 | 0.0484 | 0.0000 | 0.0000 | 1.9 |
| 28 | 81 | 1.6 | 13 | 0.20 | 0.0484 | 0.0000 | 0.0000 | 1.7 |
| 29 | 81 | 0.8 | 13 | 0.20 | 0.0000 | 0.0000 | 0.0000 | 4.4 |
| 30 | 81 | 1.2 | 13 | 0.20 | 0.0000 | 0.0000 | 0.0000 | 4.4 |
| 31 | 81 | 1.6 | 13 | 0.20 | 0.0000 | 0.0000 | 0.0000 | 4.4 |

TABLE 15

| Second fluid: Composition | | | |
|---|---|---|---|
| Concentration (% by weight) | | | |
| HMH | KOH | PW | pH |
| 70.00 | 10.00 | 20.00 | 14< |

TABLE 16

| Example | First fluid | | Second fluid | |
|---|---|---|---|---|
| | Supply flow rate (mL/minute) | Supply temperature (° C.) | Supply flow rate (mL/minute) | Supply temperature (° C.) |
| 24 | 400 | 151 | 50 | 30 |
| 25 | 400 | 153 | 50 | 30 |
| 26 | 400 | 155 | 50 | 30 |
| 27 | 400 | 151 | 50 | 30 |
| 28 | 400 | 150 | 50 | 30 |
| 29 | 400 | 152 | 50 | 30 |
| 30 | 400 | 154 | 50 | 30 |
| 31 | 400 | 151 | 50 | 30 |

TABLE 17

| Example | First fluid pH | $SO_4^{2-}$/Ni | Crystallite diameter d (nm) | Particle diameter D (nm) | d/D | PEG 600 Concentration (% by weight) |
|---|---|---|---|---|---|---|
| 24 | 1.9 | 1.24 | 54.0 | 151.2 | 0.36 | 0.0 |
| 25 | 2.0 | 1.24 | 30.1 | 79.6 | 0.38 | 0.4 |
| 26 | 2.0 | 1.24 | 34.4 | 81.2 | 0.42 | 0.8 |
| 27 | 1.9 | 1.24 | 36.9 | 76.9 | 0.48 | 1.2 |
| 28 | 1.7 | 1.24 | 31.3 | 81.1 | 0.39 | 1.6 |
| 29 | 4.4 | 1.00 | 53.0 | 311.2 | 0.17 | 0.8 |
| 30 | 4.4 | 1.00 | 31.1 | 251.4 | 0.12 | 1.2 |
| 31 | 4.4 | 1.00 | 16.7 | 206.1 | 0.08 | 1.6 |

From Table 17, in Examples 25 to 27, in which the molar ratio of $SO_4^{2-}$/Ni, i.e., the molar ratio of the sulfate ion relative to the nickel contained in the first fluid, was 1.24, there was a tendency that by increasing the concentration of polyethylene glycol 600, the crystallite's diameter (d) of the nickel microparticle increased, but the particle diameter (D) thereof did not become so large. It was confirmed that there is a tendency that while suppressing the growth of the particle diameter of the separated nickel microparticle, the growth of the crystallite's diameter is facilitated. In addition, it was confirmed that there is a tendency that the growth of the particle diameter is suppressed as the crystallite grows. Therefore, it was confirmed that by increasing the concentration of polyethylene glycol 600, there is a tendency that the ratio of d/D becomes larger. Further, in Examples 24 to 28, the nickel microparticle having 0.30 or more in the ratio of d/D and 30 nm or more in the crystallite's diameter (d) could be obtained.

In Examples 29 to 31, in which the molar ratio of $SO_4^{2-}$/Ni, i.e., the molar ratio of the sulfate ion relative to the nickel contained in the first fluid, was 1.00, there is a tendency that by increasing the concentration of polyethylene glycol 600, the crystallite's diameter (d) and the particle diameter (D) of the nickel microparticle become smaller. Therefore, it was confirmed that by increasing the concentration of polyethylene glycol 600, there is a tendency that the ratio of d/D becomes smaller. Further, in Examples 29 to 30, the nickel microparticle having 30 nm or more in the crystallite's diameter (d) could be obtained, though the ratio d/D thereof was significantly lower than 0.30.

Accordingly, it was shown that there is a possibility that in the region where the molar ratio of $SO_4^{2-}$/Ni, i.e., the molar ratio of the sulfate ion relative to the nickel contained in the first fluid, is more than 1.00, by increasing the concentration of polyethylene glycol 600, the ratio of d/D may be made larger.

1 first processing surface
2 second processing surface
10 first processing member
11 first holder
20 second processing member
21 second holder
d1 first introduction part
d2 second introduction part
d20 opening

The invention claimed is:

1. A method for producing nickel microparticle, wherein the method uses at least two fluids to be processed, of these, at least one fluid to be processed is a nickel compound fluid in which a nickel compound is dissolved in a solvent, the nickel compound fluid contains a sulfate ion, at least one fluid to be processed other than the foregoing fluid to be processed is a reducing agent fluid in which a reducing agent is dissolved in a solvent, at least any one fluid to be processed of the nickel compound fluid and the reducing agent fluid contains a polyol, these fluids to be processed are mixed to form a thin film fluid between at least two processing surfaces which are disposed in a position they are faced with each other so as to be able to approach to and separate from each other, at least one of which rotates relative to the other, whereby the nickel microparticle is separated, controlling a pH of the nickel compound fluid which is introduced into between the at least two processing surfaces and also a molar ratio of the sulfate ion relative to the nickel contained in the nickel compound fluid such that the nickel microparticle has a crystallite diameter (d) of 30 nm or more, and a ratio of d/D of 0.30 or more, wherein D is a particle diameter of the nickel microparticle.

2. The method for producing nickel microparticle according to claim 1, further comprising a) keeping the pH at room temperature of the nickel compound fluid which is introduced into between the at least two processing surfaces constant in an acidic condition while increasing the molar ratio of the sulfate ion relative to the nickel contained in the nickel compound fluid to increase the ratio d/D, or b) keeping the pH at room temperature of the nickel compound fluid which is introduced into between the at least two processing surfaces constant in an acidic condition while decreasing the molar ratio of the sulfate ion relative to the nickel contained in the nickel compound fluid to decrease the ratio d/D.

3. The method for producing nickel microparticle according to claim 2, wherein pH of the nickel compound fluid at room temperature is 4.1 or lower, and the molar ratio of the sulfate ion relative to the nickel contained in the nickel compound fluid is more than 1.0.

4. The method for producing nickel microparticle according to claim 2, wherein pH of the nickel compound fluid at room temperature is in the range of 4.1 or more and 4.4 or lower, and the molar ratio of the sulfate ion relative to the nickel contained in the nickel compound fluid is more than 1.1.

5. The method for producing nickel microparticle according to claim 2, wherein pH of the nickel compound fluid at room temperature is in the range of 4.1 or more and 4.4 or lower, and the molar ratio of the sulfate ion relative to the nickel contained in the nickel compound fluid is 1.2 or more.

6. The method for producing nickel microparticle according to claim 2, wherein the polyol is at least one selected from the group consisting of ethylene glycol, propylene glycol, trimethylene glycol, tetraethylene glycol, polyethylene glycol, diethylene glycol, glycerin, and polypropylene glycol.

7. The method for producing nickel microparticle according to claim 1, wherein pH of the nickel compound fluid at room temperature is 4.1 or lower, and the molar ratio of the sulfate ion relative to the nickel contained in the nickel compound fluid is more than 1.0.

8. The method for producing nickel microparticle according to claim 7, wherein the polyol is at least one selected from the group consisting of ethylene glycol, propylene glycol, trimethylene glycol, tetraethylene glycol, polyethylene glycol, diethylene glycol, glycerin, and polypropylene glycol.

9. The method for producing nickel microparticle according to claim 1, wherein pH of the nickel compound fluid at room temperature is in the range of 4.1 or more and 4.4 or lower, and the molar ratio of the sulfate ion relative to the nickel contained in the nickel compound fluid is more than 1.1.

10. The method for producing nickel microparticle according to claim 1, wherein pH of the nickel compound fluid at room temperature is in the range of 4.1 or more and 4.4 or lower, and the molar ratio of the sulfate ion relative to the nickel contained in the nickel compound fluid is 1.2 or more.

11. The method for producing nickel microparticle according to claim 1, wherein the polyol is at least one selected from the group consisting of ethylene glycol, propylene glycol, trimethylene glycol, tetraethylene glycol, polyethylene glycol, diethylene glycol, glycerin, and polypropylene glycol.

12. The method for producing nickel microparticle according to claim 1, wherein the nickel compound is a hydrate of nickel sulfate.

13. The method for producing nickel microparticle according to claim 1, wherein providing a first processing surface and a second processing surface as the at least two processing surfaces, introducing the fluids to be processed between the first processing surface and the second processing surfaces, by a pressure of the fluids to be processed, a force to move the second processing surface in a direction to separate it from the first processing surface is generated, by this force, keeping a space between the first processing surface and the second processing surface, and the fluids to be processed which go through this space that is kept between the first processing surface and the second processing surface form the thin film fluid.

14. The method for producing nickel microparticle according to claim 1, wherein the nickel compound fluid goes through between the at least two processing surfaces while forming the thin film fluid, arranging a separate introduction path independent of the flow path through which the nickel compound fluid runs, arranging at least one opening which is connected to the separate introduction path in at least any one of the at least two processing surfaces, and the reducing agent fluid is introduced through this opening into between the at least two processing surfaces, whereby the nickel compound fluid and the reducing agent fluid are mixed to form the thin film fluid.

15. A method for producing nickel microparticle, wherein the method uses at least two fluids to be processed, of these, at least one fluid to be processed is a nickel compound fluid in which a nickel compound is dissolved in a solvent, the nickel compound fluid contains a sulfate ion, at least one fluid to be processed other than the foregoing fluid to be processed is a reducing agent fluid in which a reducing agent is dissolved in a solvent, at least any one fluid to be processed of the nickel compound fluid and the reducing agent fluid contains a polyol, these fluids to be processed are mixed to form a thin film fluid between at least two processing surfaces which are disposed in a position they are faced with each other so as to be able to approach to and separate from each other, at least one of which rotates relative to the other, whereby the nickel microparticle is separated, controlling a concentration of the polyol contained in at least any one fluid to be processed of the nickel compound fluid and the reducing agent fluid that are introduced into between the at least two processing surfaces and also a molar ratio of the sulfate ion relative to the nickel contained in the nickel compound fluid such that the nickel microparticle has a crystallite diameter (d) of 30 nm or more, and a ratio of d/D of 0.30 or more, wherein D is a particle diameter of the nickel microparticle.

16. The method for producing nickel microparticle according to claim 15, wherein the nickel compound fluid contains the polyol, the polyol is ethylene glycol and polyethylene glycol, and further comprising maintaining a molar ratio of the sulfate ion relative to the nickel contained in the nickel compound fluid of 1.24 while increasing a concentration of the polyol in the nickel compound fluid to increase the ratio d/D, or maintaining a molar ratio of the sulfate ion relative to the nickel contained in the nickel compound fluid of 1.00 while increasing a concentration of the polyol in the nickel compound fluid to decrease the ratio d/D.

* * * * *